US007932917B2

(12) United States Patent
Han et al.

(10) Patent No.: US 7,932,917 B2
(45) Date of Patent: Apr. 26, 2011

(54) METHOD OF CONTROLLING PICTURE QUALITY IN FLAT PANEL DISPLAY FOR COMPENSATING BRIGHTNESS OF A DISPLAY STAIN OF INDETERMINATE SHAPE

(75) Inventors: Sang Chul Han, Seoul (KR); Jong Hee Hwang, Gyeonggi-do (KR); Hye Jin Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 920 days.

(21) Appl. No.: 11/881,736

(22) Filed: Jul. 27, 2007

(65) Prior Publication Data

US 2008/0049051 A1 Feb. 28, 2008

(30) Foreign Application Priority Data

Jul. 28, 2006 (KR) ..... 10-2006-0071381

(51) Int. Cl.
*G09G 5/10* (2006.01)

(52) U.S. Cl. ..... 345/690; 345/904; 324/760.01

(58) Field of Classification Search ..... 345/904, 345/90, 690, 77, 89; 324/760.01–760.02
See application file for complete search history.

(56) References Cited

U.S. PATENT DOCUMENTS 5,293,178 A * 3/1994 Kobayashi ..... 345/904
5,764,209 A * 6/1998 Hawthorne et al. ..... 345/87
5,917,935 A * 6/1999 Hawthorne et al. ..... 382/149
6,208,327 B1 * 3/2001 Ho et al. ..... 345/690
7,034,298 B2 * 4/2006 Miyai et al. ..... 324/760.01
7,212,024 B2 * 5/2007 Iwasaki et al. ..... 324/760.01
7,742,028 B2 * 6/2010 Nitta et al. ..... 345/88
2003/0214586 A1 * 11/2003 Lee et al. ..... 348/180
2005/0007364 A1 * 1/2005 Oyama et al. ..... 345/428
2006/0007196 A1 * 1/2006 Chen ..... 345/204
2006/0164407 A1 * 7/2006 Cok ..... 345/204
2007/0109327 A1 * 5/2007 Cok et al. ..... 345/690

* cited by examiner

*Primary Examiner* — Chanh Nguyen
*Assistant Examiner* — Adam J Snyder
(74) *Attorney, Agent, or Firm* — Brinks Hofer Gilson & Lione

(57) ABSTRACT

A method of controlling a picture quality of a flat panel display for automatically analyzing a shape, a size, and brightness of a display stain of indeterminate shape having an irregular pattern, and compensating brightness of the display stain of indeterminate shape on the basis of the analyzed result is disclosed. The method of controlling a picture quality of the flat panel display comprises measuring brightness of a display stain, which is generated on a flat display panel, at a vertical direction and a horizontal direction, respectively; imaginarily dividing the display stain in a predetermined distance along a direction that a brightness change is large among the vertical direction and the horizontal direction in accordance with the measured result; detecting edge points where divided border lines of the divided display stains and an edge of the display stain are joined; determining compensation values, which are applied to a plurality of compensation applying surfaces that are defined by the edge points and the divided border lines within the display stain; and adjusting digital video data to be displayed at the compensation applying surfaces using the compensation values.

9 Claims, 21 Drawing Sheets

METHOD OF CONTROLLING PICTURE QUALITY IN FLAT PANEL DISPLAY FOR COMPENSATING BRIGHTNESS OF A DISPLAY STAIN OF INDETERMINATE SHAPE

This application claims the benefit of Korean Patent Application No. P2006-071381 in Korea on Jul. 28, 2006, which is hereby incorporated by reference.

BACKGROUND OF THE INVENTION

1. Field of the Invention

The present invention relates to a flat panel display, and more particularly to a method of controlling a picture quality of a flat panel display that is adaptive for automatically analyzing a shape, a size, and brightness of a display stain of indeterminate shape having an irregular pattern, and compensating brightness of the display stain of indeterminate shape on the basis of the analyzed result.

2. Description of the Related Art

Recently, there has been paid attention to various flat panel display devices which can reduce their weight and size that are a disadvantage of a cathode ray tube. The flat panel display devices include a liquid crystal display LCD, a field emission display device FED, a plasma display panel, and an organic light emitting diode OLED and the like.

The flat panel display device includes a display panel for displaying a picture. A display stain has been showed in a test process of the display panel. The picture quality defect has a different brightness or chromaticity compared to a normal display surface.

A display stain, which is found in a test process of the display panel, is primarily generated by a process deviation in manufacturing process. For example, a display stain is generated by an exposure deviation of a photo-resist due to an overlap of lenses and a lens aberration, etc in an exposure process. Such an exposure deviation of a photo-resist causes a deviation of a parasitic capacitance between gate electrode and drain electrode (or source electrode) of a thin film transistor TFT, which is formed by a photolithography process, a height deviation of a column spacer that maintains a cell gap, and a deviation of a parasitic capacitance between a signal line and a pixel electrode. As a result, an exposure deviation of a photo-resist causes a difference of brightness or chromaticity at a display image.

A display stain may be generated in a fixed shape such as dot, line, belt, block, circle, and polygon, etc., or in an indeterminate shape having an irregular pattern. The display stain of indeterminate shape, a shape as well as a difference of brightness or chromaticity is not uniform as shown in FIG. 1. In a display stain of indeterminate shape, it is difficult to automatically measure a pattern thereof and a degree of a stain. Thus, the display panel, which the display stain of indeterminate shape is found in a test process, goes into the discard due to a display stain of indeterminate shape, and the display stain of indeterminate shape make worse a yield.

SUMMARY OF THE INVENTION

The present invention is to solve the above-mentioned problem. Accordingly, it is an object of the present invention to provide a method of controlling a picture quality of a flat panel display that is adaptive for automatically analyzing a display stain, and compensating brightness of the display stain of indeterminate shape on the basis of the analyzed result.

In order to achieve these and other objects of the invention, a method of controlling a picture quality of a flat panel display according to an embodiment of the present invention comprises measuring brightness of a display stain, which is generated on a flat display panel, at a vertical direction and a horizontal direction, respectively; imaginarily dividing the display stain in a predetermined distance along a direction that a brightness change is large among the vertical direction and the horizontal direction in accordance with the measured result; detecting edge points where divided border lines of the divided display stains and an edge of the display stain are joined; determining compensation values, which are applied to a plurality of compensation applying surfaces that are defined by the edge points and the divided border lines within the display stain; and adjusting digital video data to be displayed at the compensation applying surfaces using the compensation values.

Brightness of the display stain is different from brightness of a normal display surface in the same gray scale.

The display stain includes a display stain having brightness lower than the normal display surface, a display stain having brightness higher than the normal display surface, and a bright line having brightness higher than the normal display surface.

The compensation value is differentiated depending upon a gray scale value of the digital video data and a pixel location of the display stain.

The compensation value is added to a display stain having brightness lower than the normal display surface.

The compensation value is subtracted from a display stain having brightness higher than the normal display surface and a bright line having brightness higher than the normal display surface.

The compensation value is stored at a volatile memory, which is capable of updating data, along location information that indicates each pixel location of the display stain.

The step of adjusting the digital video data using the compensation values includes judging display locations of the digital video data on the basis of the location information; and selecting digital video data to be displayed at the display stain to selectively modulate the digital video data using the compensation value.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIG. 2 to FIG. 21.

Figure 1:
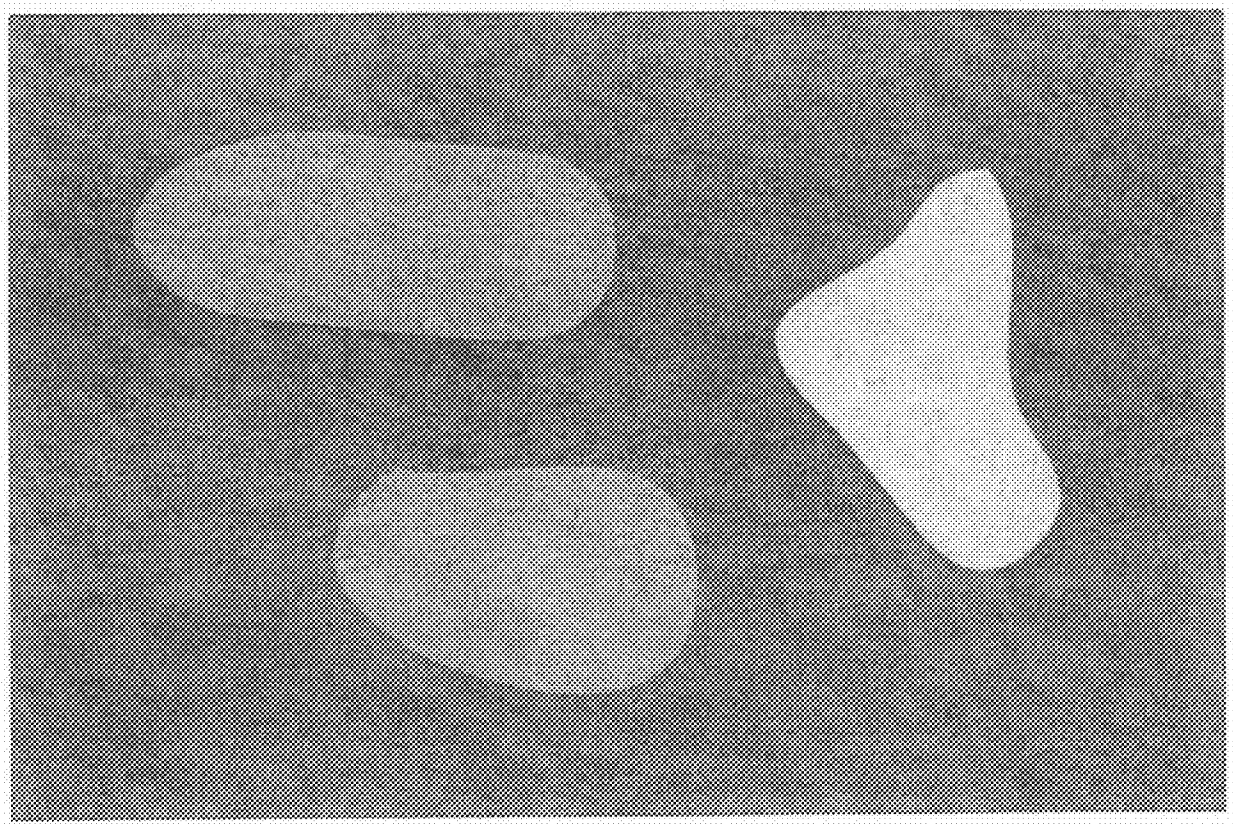
FIG. 1 RELATED ART
FIG. 1 is a diagram showing an example of a display stain of indeterminate shape.
Figure 2:
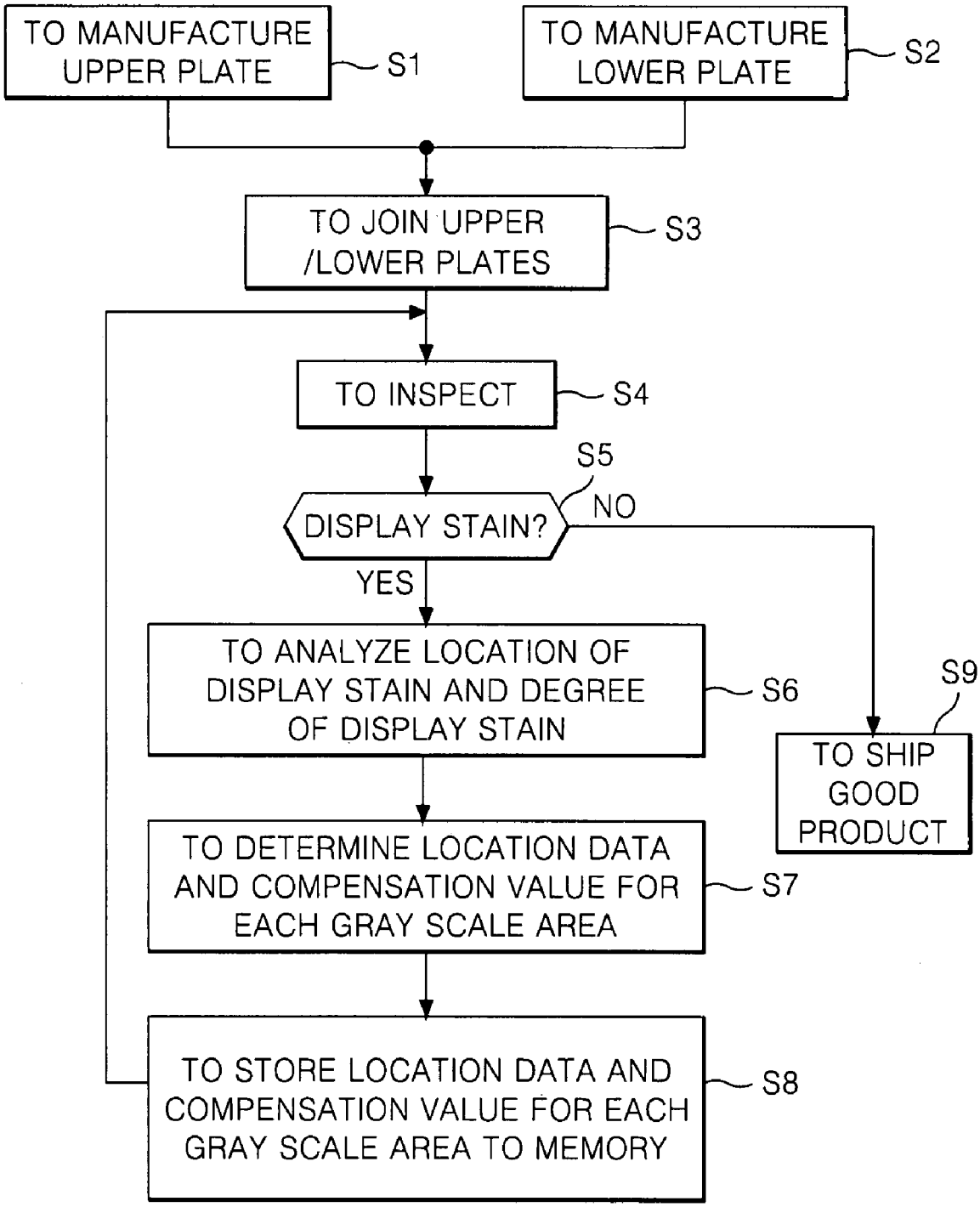
FIG. 2 is a flow chart showing a method of fabricating a flat panel display according to an embodiment of the present invention, step by step.

Referring to FIG. 2, a method of fabricating a flat panel display according to an embodiment of the present invention manufactures an upper plate and a lower plate, and then joins the upper plate with the lower plate using a sealant or a frit glass. (S1, S2, and S3) Herein, the upper plate and the lower plate may be manufactured in accordance with a kind of a flat display panel. For example, in case of a liquid crystal display panel, a color filter, a black matrix, a common electrode, and an upper alignment film, etc may be formed at an upper plate. A data line, a gate line, a TFT, a pixel electrode, a lower alignment film, a column spacer, etc may be formed at a lower plate. In case of a plasma display panel, an address electrode, a lower dielectric substance, a barrier rib, a phosphor, etc may be formed at a lower plate, and an upper dielectric substance, a MgO protective film, a sustain electrode pair, etc may be formed at an upper plate.

Next, a process of inspecting a flat panel display applies test data of each gray scale to a flat panel display regarding a flat panel display where an upper/lower plates are joined, to display a test image, and brightness and chromaticity of an entire display surface are measured by an electric inspection using a measuring device such as a camera, etc., and/or a visible inspection regarding the image.(S4) If a display stain is found in a flat panel display for an inspection process (S5), a location where the display stain is generated and brightness of a display stain surface are analyzed. (S6) Herein, as described above, a display stain includes a display stain having brightness lower or higher than a normal display surface such as dot, line, belt, block, circle, and polygon, etc., a display stain of indeterminate shape, and a brightness lamp line having brightness higher than a border part between a display stain and a normal display surface, or a normal display surface.

Figure 3:
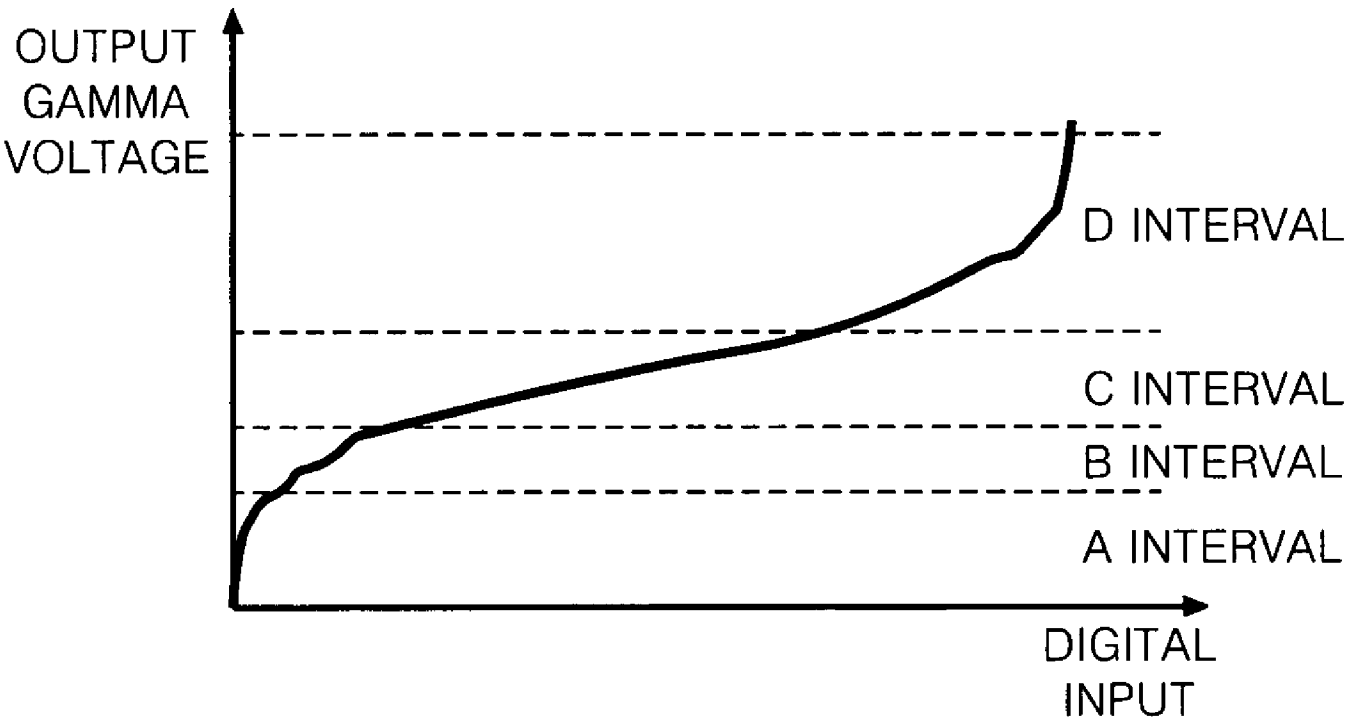
FIG. 3 is a graph showing a gamma characteristics for each gray scale of the flat panel display.

Furthermore, the present invention determines a location data, which indicates each pixel of a display stain, and a compensation value for each gray scale area, and then stores a location data, which indicates a location data for each pixel of a display stain, and compensation data, which are added to and subtracted from digital video data, at a memory via a user connector and a ROM writer in a process of judging a display stain. (S7 and S8) A compensation values, which are added to or subtracted from digital video data, should be optimized for each gray scale areas (A to D) in consideration of an analog gamma characteristics of the flat display panel as shown in FIG. 3. For example, compensation values are differentiated for each location having a different brightness at a display stain or a bright line. Also, the compensation values are differentiated depending upon a gray scale at the same location. In other words, a compensation value for each gray scale area of a display stain is differentiated depending upon a location of a display stain, a brightness difference between a display stain and a normal display surface, and gray scale values of digital video data to be displayed at a display stain, etc.

A memory, which stores compensation values and location data, includes a non-volatile memory that is capable of updating and removing data, for example, a memory (Electrically Erasable Programmable Read Only Memory) and/or an EDID ROM (Extended Display Identification Data ROM). On the other hand, identification information of a distributor/a producer, and a characteristics and a parameter of a basic display device as monitor information data other than compensation values and location data are basically stored at the EDID ROM. In this case, compensation values and location data, which are stored at the memory, are stored in a look-up table pattern which outputs a compensation value responding to the digital video data and location information as a read address.

In the S5 step, if a size, the number, and a degree of a display stain are found under the good product permissible reference level, the flat panel display is turned out to be a good product to be shipped. (S9)

The method of controlling the flat panel display according to the embodiment of the present invention adds compensation values to and subtracts compensation values from digital video data, which are generated in block, surface, line, dot, and indeterminate shape, etc., and are to be displayed at a display stain having brightness lower or higher than a normal display surface, and digital video data, which are to be displayed at a bright line having brightness higher than a normal display surface, to modulate the digital video data. Herein, a compensation value is added to digital video data, which are to be displayed at a display stain having brightness lower than a normal display surface at the same gray scale. On the other hand, a compensation value is subtracted from digital video data, which are to be displayed at a display stain or a bright line having brightness higher than a normal display surface at the same gray scale. In this way, the flat panel display according to the present invention compensates brightness of a display stain having a bright line, which is generated by an error of a manufacturing process, to be similar to a normal display surface by modulating data.

Figure 4:
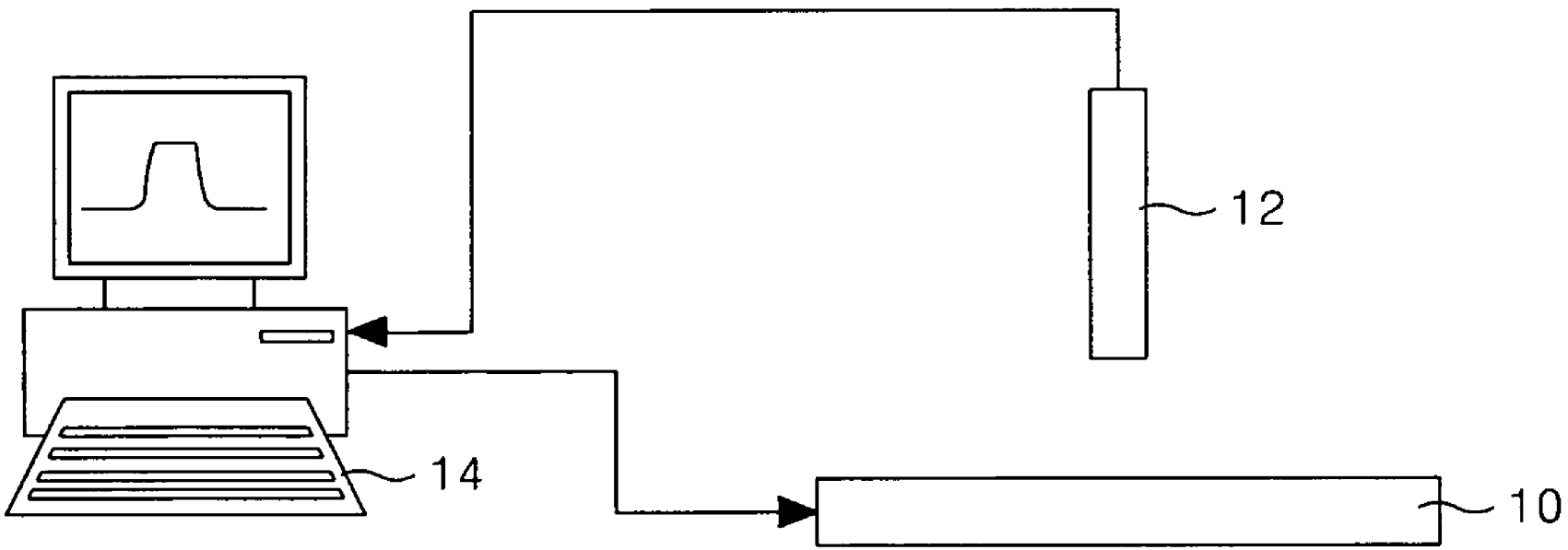
FIG. 4 is a diagram showing a measuring system that automatically measures brightness and a shape of a display stain and automatically optimizes a compensation value in accordance with a measured brightness and shape of a display stain, and gray scale values of digital video data.

FIG. 4 is a diagram showing a measuring system that automatically measures brightness and a shape of a display stain and automatically optimizes a compensation value in accordance with a measured brightness and shape of a display stain, and gray scale values of digital video data.

Referring to FIG. 4, a measuring system of the flat panel display according to the embodiment of the present invention includes a sensing device 12 and a computer 14. Herein, the sensing device 12 senses brightness and chromaticity of a flat display panel 10. The computer 14 supplies test data to the flat display panel 10, and receive brightness and chromaticity signals from the sensing device 12.

The sensing device 12 includes a camera and/or an optical sensor and senses brightness and chromaticity of a test image, which is displayed at the flat display panel 10, to generate a voltage or a current, and then converts the voltage or the current into digital sensing data to supply them to the computer 14.

The computer 14 supplies test data to a driving circuit of the flat display panel for each gray scale, and judges brightness and chromaticity regarding entire display surfaces of the flat display panel for each gray scale of a test image in accordance with digital sensing data which are inputted from the sensing device 12. Furthermore, the computer 14 executes a pre-stored display stain searching program to automatically detect an image of a display stain for each gray scale, and then adds a compensation value to and subtracts a compensation value from digital video data, which are to be displayed at a display stain for each gray scale, to monitor a brightness difference between a display stain and a normal display surface. When a brightness difference between a display stain and a normal display surface is reached at less than a predetermined reference value, the computer 14 automatically determines a compensation value, which is added to and subtracted from digital video data to be displayed at a display stain, to an optimum value. The predetermined reference value is a value that a brightness difference between a display stain and a normal display surface is not recognized with the naked eyes, and is determined by the experiment.

Figure 5:
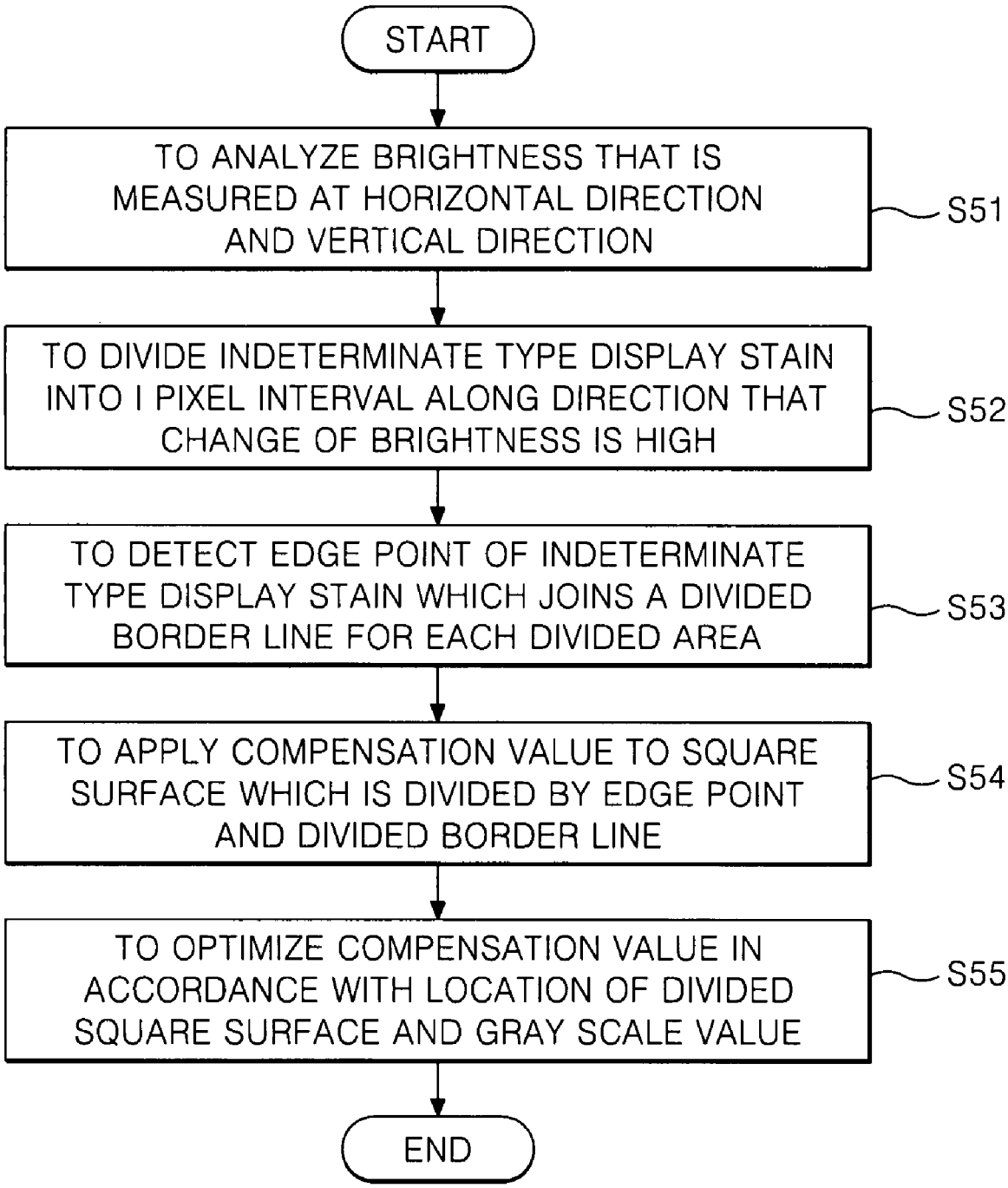
FIG. 5 is a flow chart showing a control sequence of a display stain of indeterminate shape searching program, step by step.

FIG. 5 shows a control sequence of a display stain of indeterminate shape searching program, which is executed by the computer 14 in FIG. 4, step by step. And, FIG. 6 to FIG. 9 show a searching example of a display stain of indeterminate shape.

Figure 6:
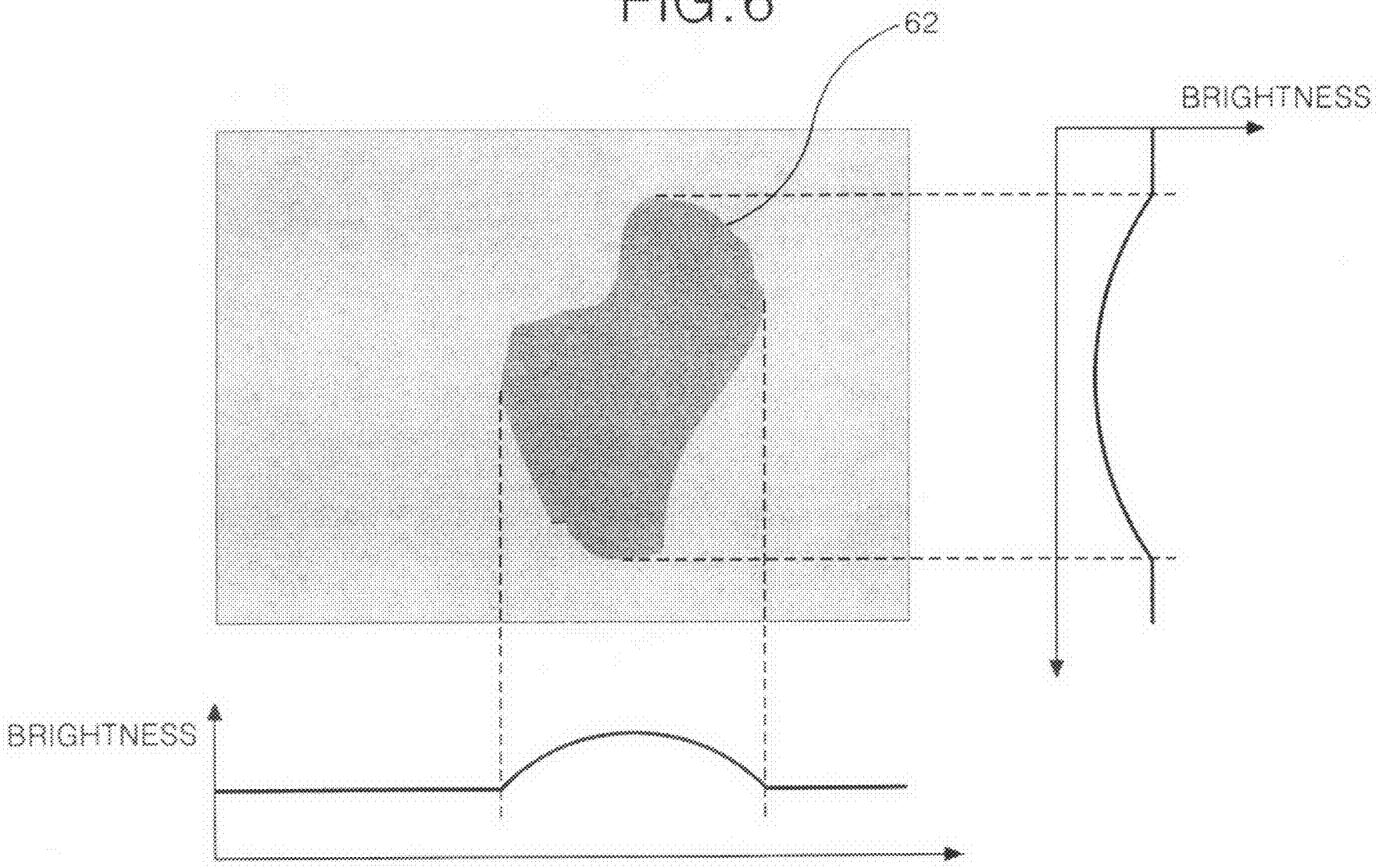
FIG. 6 to FIG. 9 are diagrams showing an example of a display stain of indeterminate shape for explaining a method of searching a display stain of indeterminate shape.
Figure 7:
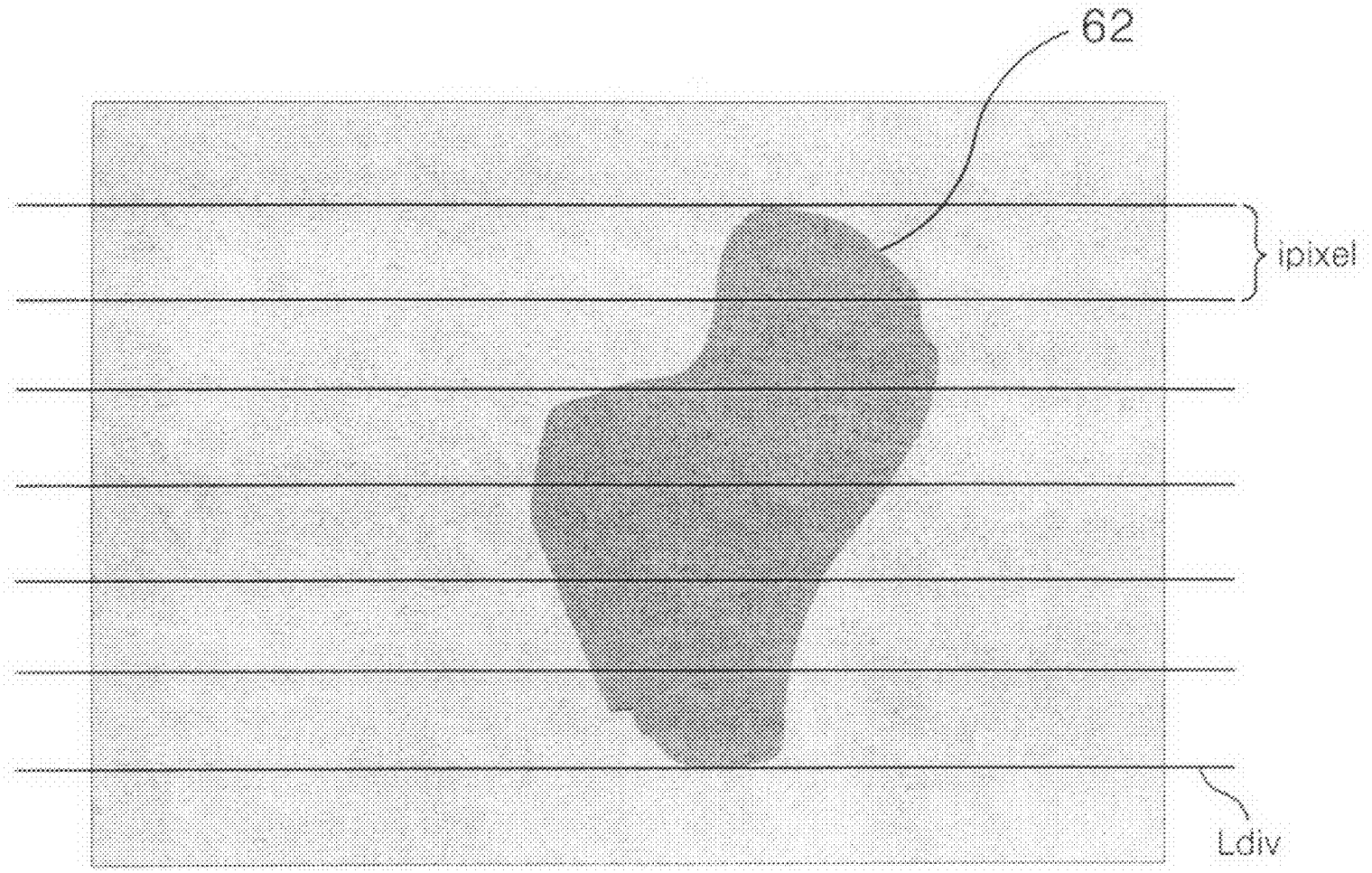
Figure 8:
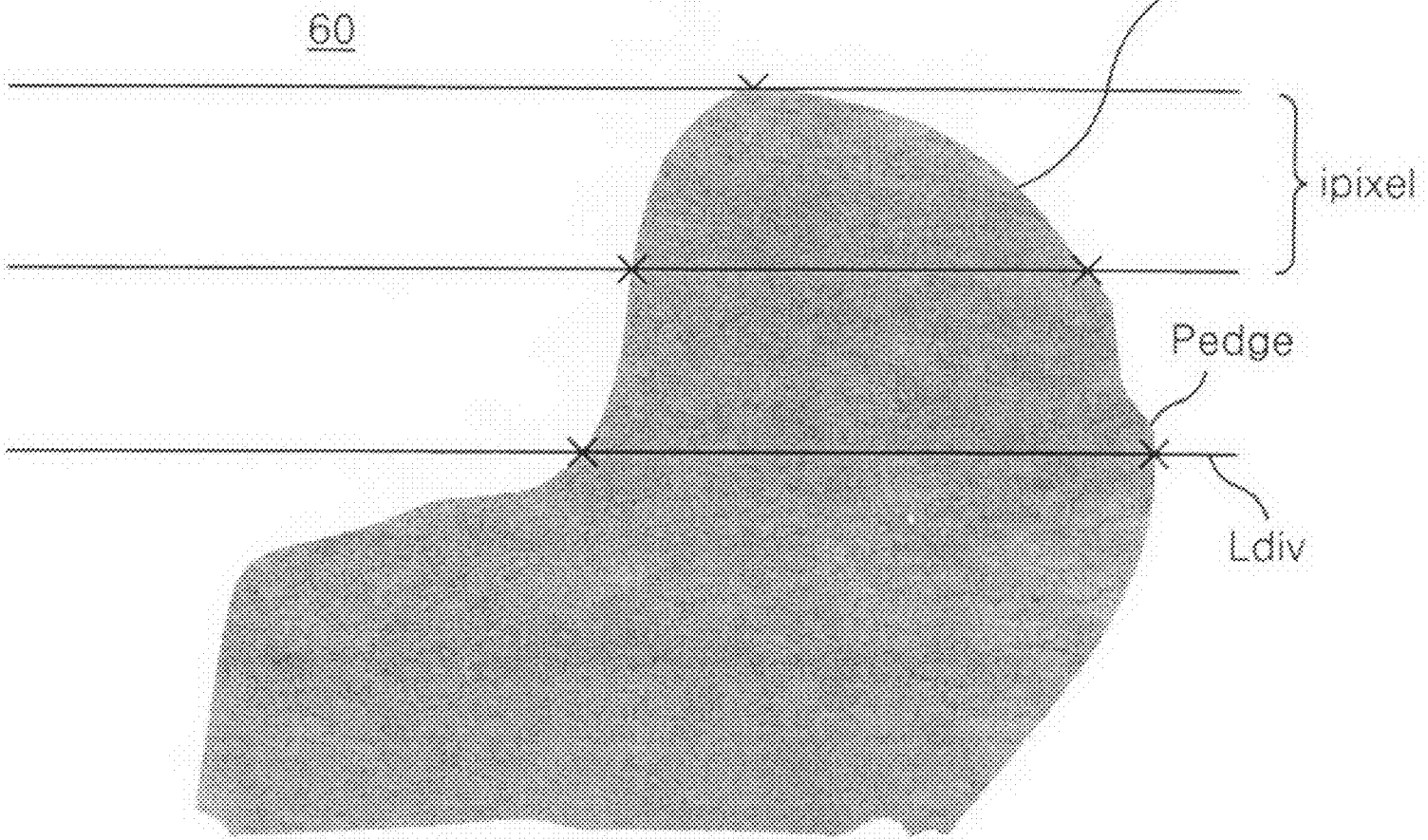
Figure 9:
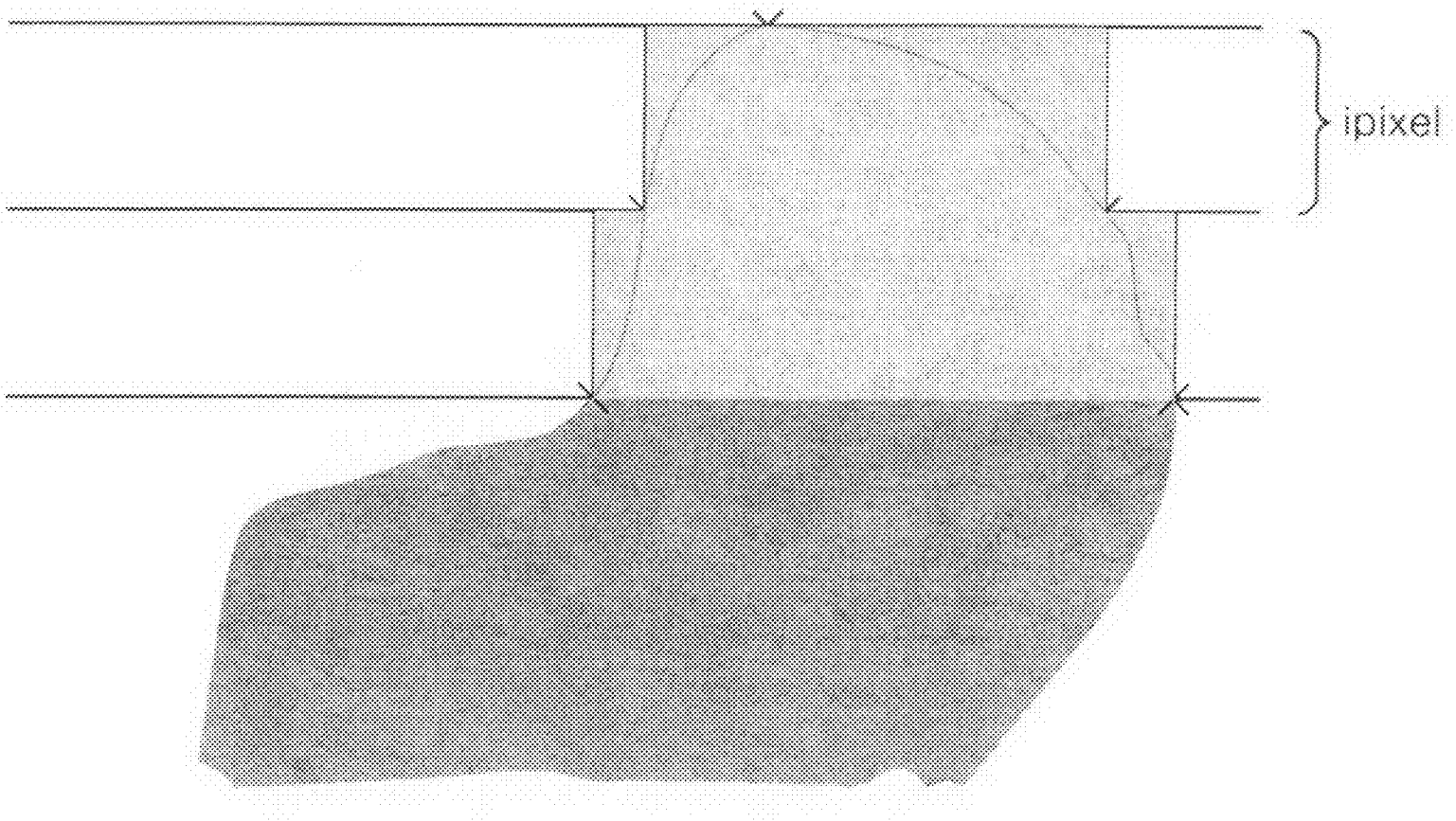

Referring to FIG. 5 to FIG. 9, a display stain of indeterminate shape searching program according to the embodiment of the present invention analyzes brightness that are measured by the sensing device 12 at a horizontal direction and a vertical direction of a display stain of indeterminate shape 62 and a normal display surface 60, which makes a border with the display stain of indeterminate shape 62 as shown in FIG. 6, respectively.(S51) The display stain of indeterminate shape searching program selects a direction having a high brightness change between the display stain of indeterminate shape 62 and the normal display surface 60, which makes a border with the display stain of indeterminate shape 62, and judges borders of the normal display surface 60 and the display stain of indeterminate shape 62 of which brightness is changed at a selected direction, and then imaginarily divides the display stain of indeterminate shape 62, which is determined along the border from the selected direction, in a i (herein, i is a positive integer more than 2) pixel distance. Herein, an distance, which is imaginarily divided within the display stain of indeterminate shape 62, is differentiated depending upon a degree of a brightness change within the display stain of indeterminate shape 62. For example, if a brightness change is high within the display stain of indeterminate shape 62, 'i' is decreased. If a brightness change is low within the display stain of indeterminate shape 62, 'i' is increased. Hereinafter, it is assumed that 'i' is '8'. FIG. 8 shows a display stain of indeterminate shape having a high brightness change at a vertical direction, and an example that the display stain of indeterminate shape is imaginarily divided in a i pixel distance at a vertical direction.(S52)

Next, a display stain of indeterminate shape searching program according to the embodiment of the present invention judges an external line of a display stain of indeterminate shape, which joins with dividing lines Ldiv for each display stain surface that is divided by imagine dividing lines Ldiv, as an edge point Pedge as shown in FIG. 8, and determines square display surfaces, which are defined by an edge point Pedge and border lines Ldiv, as a compensation applying surface where a compensation value is to be applied. (S53)

FIG. 10 to FIG. 13 show examples of divided compensation applying surfaces and compensation values which are applied to the divided compensation applying surfaces in the case where a brightness change is different within a display stain of indeterminate shape. Herein, Brightness of the display stain of indeterminate shape shown in FIG. 10 to FIG. 13 is lower than a normal display surface at the same gray scale.

Figure 10:
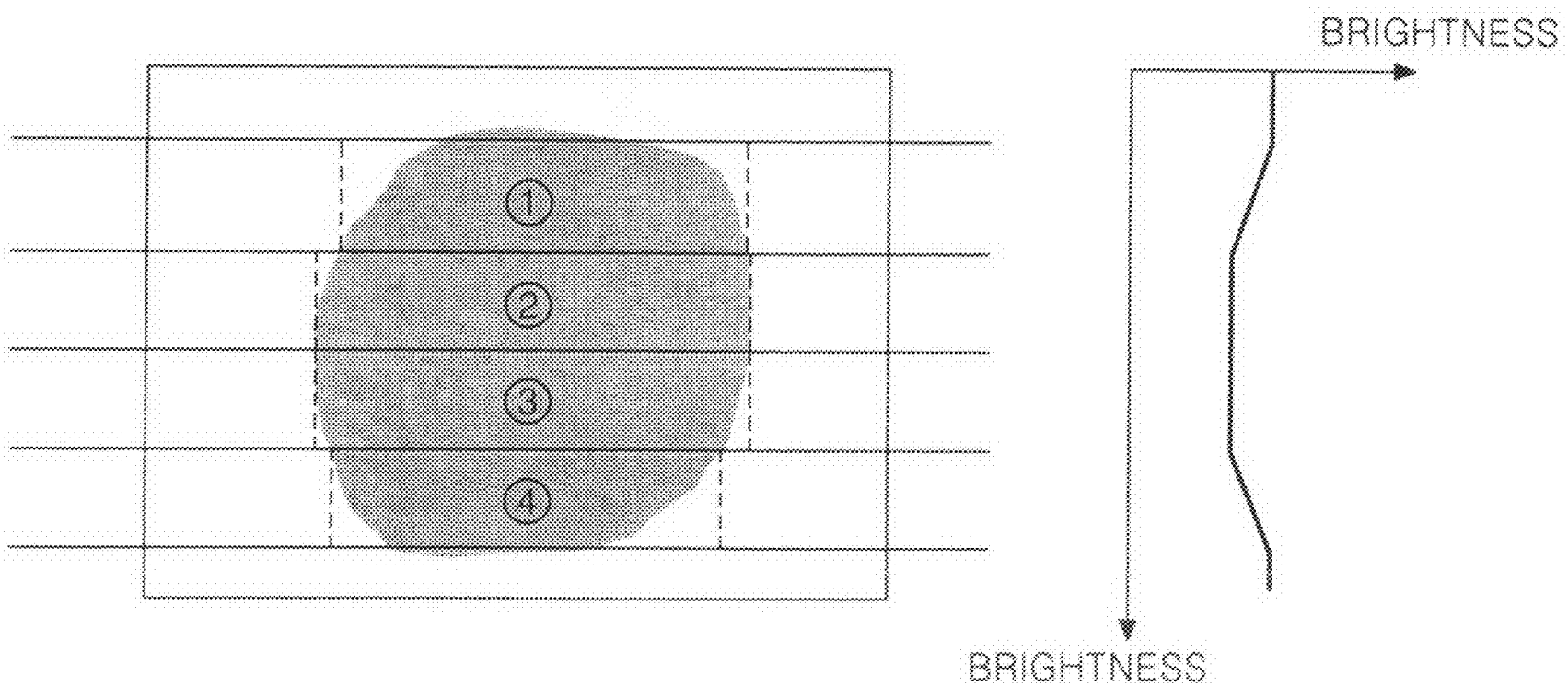
FIG. 10 to FIG. 13 are diagrams showing examples of divided compensation applying surfaces and compensation values which are applied to the divided compensation applying surfaces.

FIG. 10 is an example of a display stain of indeterminate shape having a higher brightness change at a vertical direction than a horizontal direction. In FIG. 10, if a display stain of indeterminate shape is divided into a first to fourth compensation applying surfaces along a vertical direction, and a brightness change at a vertical direction is the same as a graph of the right side, compensation values, which are optimized for each gray scale at each of the compensation applying surfaces, are as following Table 1.

TABLE 1

| | First compensation applying surface | Second compensation applying surface | Third compensation applying surface | Fourth compensation applying surface |
|---|---|---|---|---|
| G30~G80 | 2 | 3 | 3 | 1 |
| G81~G150 | 4 | 5 | 5 | 3 |
| G151~G250 | 6 | 8 | 8 | 5 |

In Table 1, 'Gxy' of the leftmost column represents gray scales of digital video data to which a compensation value is added. In FIG. 10, a circle number represents a serial number of a compensation applying surface.

Figure 11:
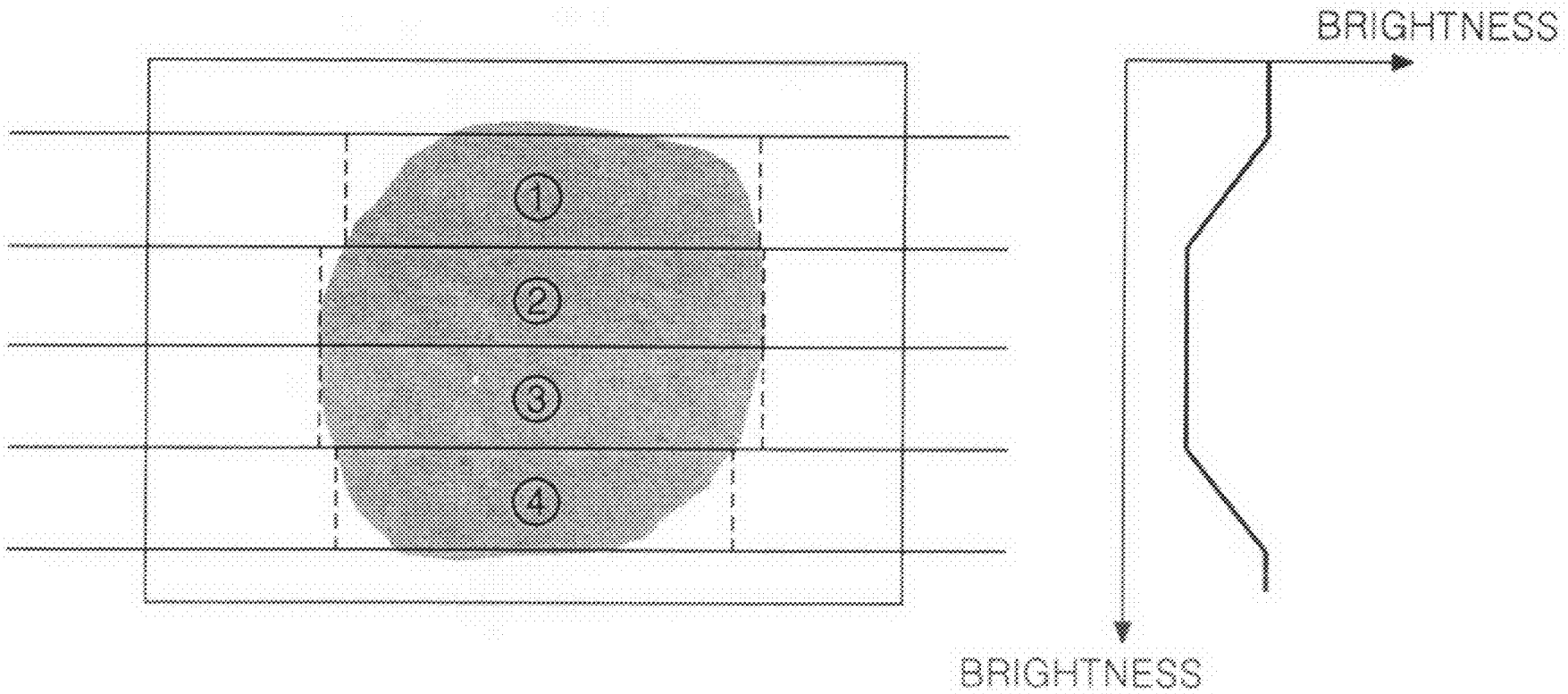

FIG. 11 is an example of a display stain of indeterminate shape that has a higher brightness change at a vertical direction than a horizontal direction, and that brightness of a second and third compensation applying surfaces is lower at each of gray scales than the display stain of indeterminate shape in FIG. 10. In FIG. 11, if a display stain of indeterminate shape is divided into a first to fourth compensation applying surfaces along a vertical direction, and a brightness change at a vertical direction is the same as a graph of the right side, compensation values, which are optimized for each gray scale at each of the compensation applying surfaces, are as following Table 2.

TABLE 2

| | First compensation applying surface | Second compensation applying surface | Third compensation applying surface | Fourth compensation applying surface |
|---|---|---|---|---|
| G30~G80 | 2 | 4 | 4 | 2 |
| G81~G150 | 5 | 8 | 8 | 5 |
| G151~G250 | 7 | 11 | 11 | 7 |

Figure 12:
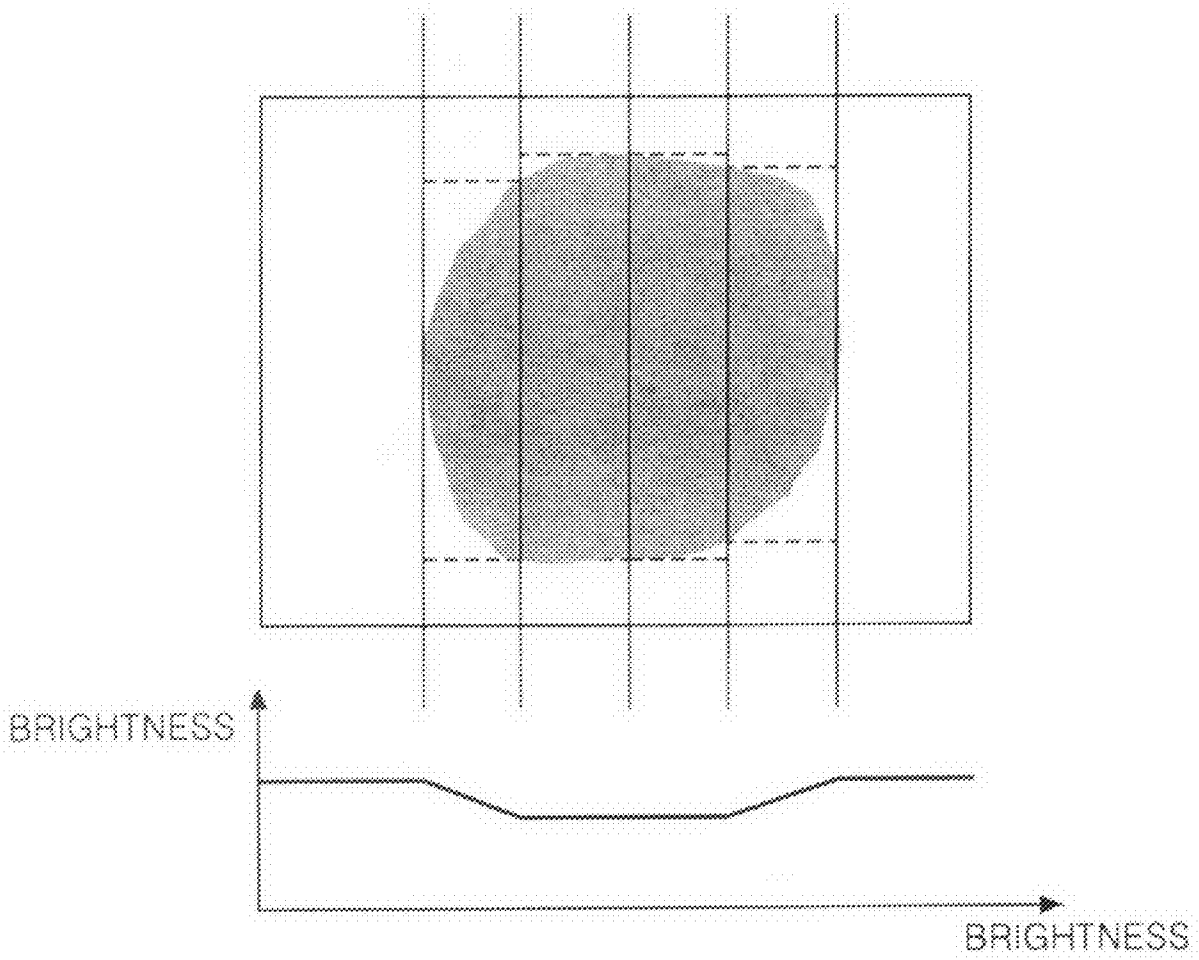

FIG. 12 is an example of a display stain of indeterminate shape having a higher brightness change at a horizontal direction than a vertical direction. In FIG. 12, if a display stain of indeterminate shape is divided into a first to fourth compensation applying surfaces along a horizontal direction, and a brightness change at a horizontal direction is the same as a graph of the right side, compensation values, which are optimized for each gray scale at each of the compensation applying surfaces, are as following Table 3.

TABLE 3

| | First compensation applying surface | Second compensation applying surface | Third compensation applying surface | Fourth compensation applying surface |
|---|---|---|---|---|
| G30~G80 | 2 | 3 | 3 | 1 |
| G81~G150 | 4 | 5 | 5 | 3 |
| G151~G250 | 6 | 8 | 8 | 5 |

Figure 13:
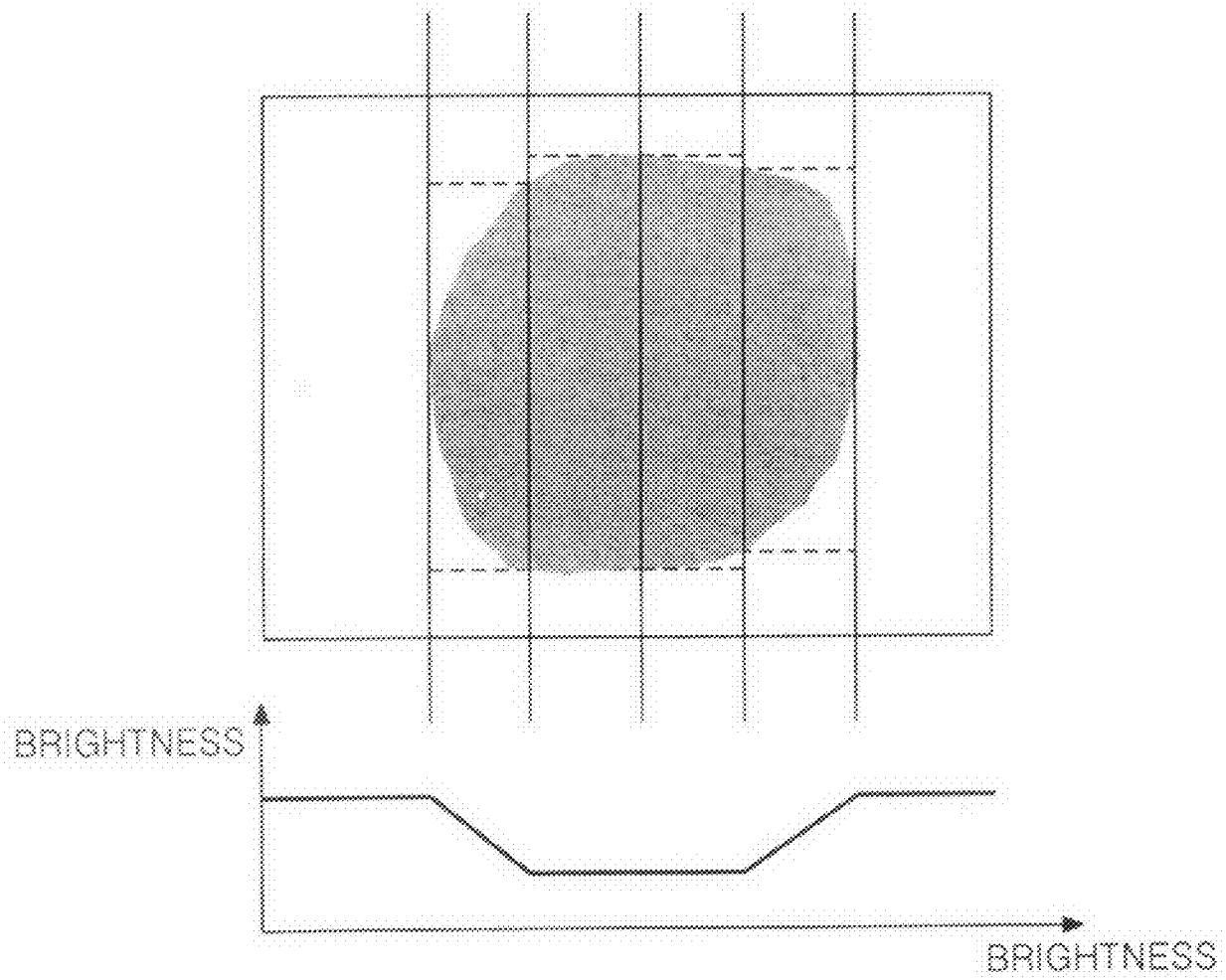

FIG. 13 is an example of a display stain of indeterminate shape that has a higher brightness change at a horizontal direction than a vertical direction, and that brightness of a second and third compensation applying surfaces is lower at more than an intermediate gray scale than the display stain of indeterminate shape in FIG. 12. In FIG. 13, if a display stain of indeterminate shape is divided into a first to fourth compensation applying surfaces along a horizontal direction, and a brightness change at a horizontal direction is the same as a graph of the right side, compensation values, which are optimized for each gray scale at each of the compensation applying surfaces, are as following Table 4.

TABLE 4

| | First compensation applying surface | Second compensation applying surface | Third compensation applying surface | Fourth compensation applying surface |
|---|---|---|---|---|
| G30~G80 | 1 | 3 | 3 | 1 |
| G81~G150 | 5 | 8 | 8 | 5 |
| G151~G250 | 7 | 9 | 9 | 7 |

A display stain of indeterminate shape of FIG. 10 to FIG. 13 has brightness lower than a normal display surface at the same gray scale. Thus, compensation values within Table 1 to Table 4 are added to digital video data, which are to be displayed at a compensation applying surface, to increase values of digital video data. On the other hand, in case of a display stain of indeterminate shape having brightness higher than a normal display surface at the same gray scale, compensation values, which are applied to each of the divided compensation applying surfaces, are subtracted from digital video data, which are to be displayed at a compensation applying surface, to decrease values of digital video data. Compensation values, which are applied to each of the divided compensation applying surfaces, may be determined in an integer as shown in Table 1 to Table 4. However, in order to specifically compensate brightness of a display stain of indeterminate shape, the compensation values may be determined in an integer+a decimal fraction, or a decimal fraction.

FIG. 14 to FIG. 19 show a flat panel display according to the embodiment of the present invention. Hereinafter, the flat panel display of the present invention will be described on the basis of a liquid crystal display.

Figure 14:
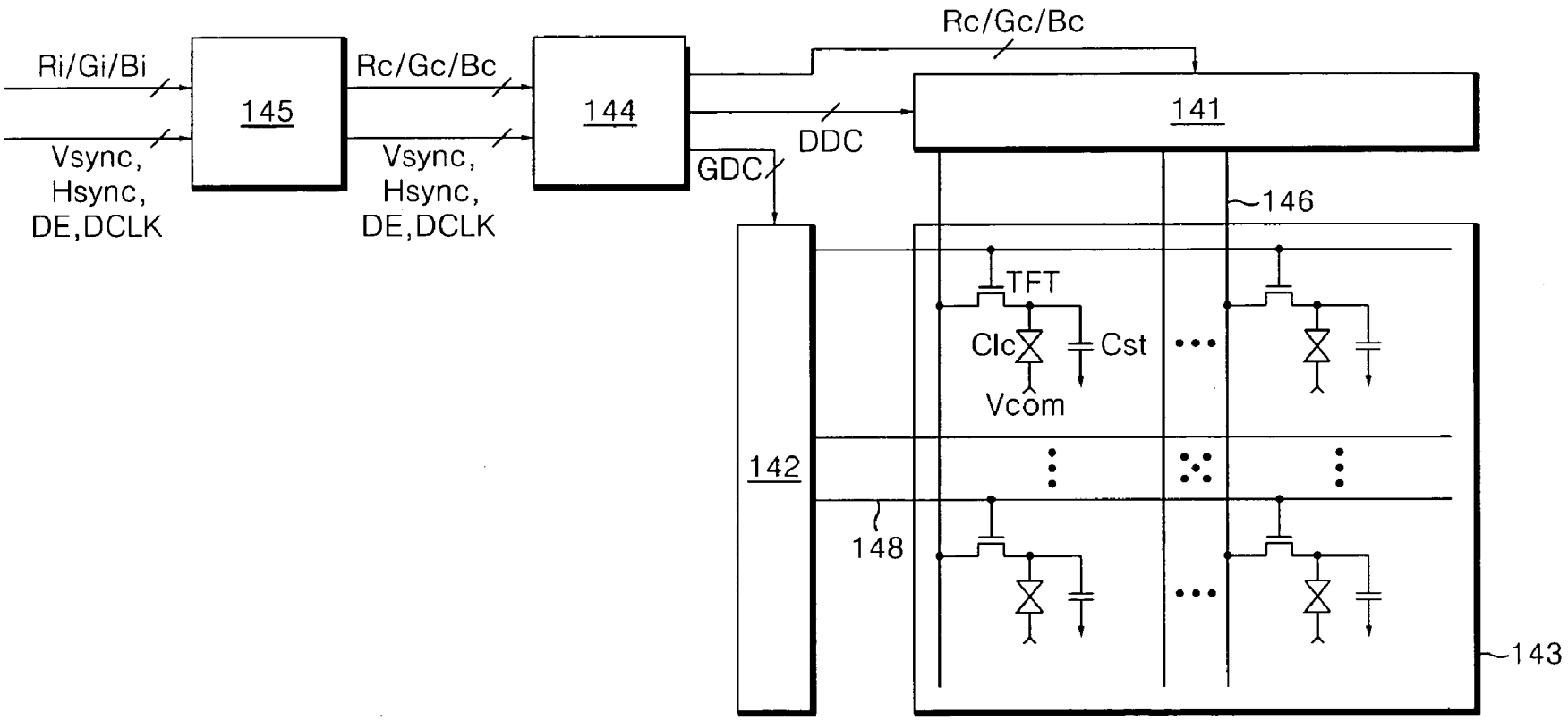
FIG. 14 is a block diagram showing a liquid crystal display according to the embodiment of the present invention.

Referring to FIG. 14, the liquid crystal display according to the embodiment of the present invention includes a display panel 143, a compensating circuit 145, a data driving circuit 141, a gate driving circuit 142, and a timing controller 144. Herein, the display panel 143 has a thin film transistor TFT which is formed to drive a liquid crystal cell Clc at a crossing part of data lines 146 and gate lines 148. The compensating circuit 145 modulates digital video data Ri/Bi/Gi to be displayed at a display stain of the display panel 143 to generate the modulated data Rc/Gc/Bc. The data driving circuit 141 supplies the modulated data Rc/Gc/Bc to the data lines 146. The gate driving circuit 142 sequentially supplies a scanning signal to the gate lines 148. The timing controller 144 controls the driving circuits 141 and 142.

Furthermore, the liquid crystal display according to the embodiment of the present invention includes a backlight unit that irradiates a light to the display panel 143. The backlight unit is largely classified into a direct type method and an edge type method depending upon a location of a light source. The backlight unit of edge type installs a light source to an edge of a one side of the display panel 143, and irradiates a light, which is incident from the light source, to the display panel 143 via a light guide plate and a plurality of optical sheets. On the other hand, the backlight unit of direct type installs a plurality of light sources under the display panel 143, and irradiates a light, which is incident from the light sources, to a liquid crystal display panel via a diffusion plate and a plurality of optical sheets. Herein, if the backlight unit of direct type is adapted, brightness of a display surface is entirely increased compared to the backlight unit. However, a light source of the backlight unit of direct type becomes bright at a display image, that is, a bright line may be shown on a display image. On the other hand, a light source of the backlight unit of direct type is comprised of a fluorescent lamps such as a Cold Cathod Fluorescent Lamp CCFL and an External Electrode Fluorescent Lamp EEFL, etc., or a light emitting diode LED or a combination of the discharge tube lamp and the light emitting diode.

In the display panel 143, a liquid crystal is dropped between two substrates (a TFT substrate and a color filter substrate). The data lines 146 and the gate lines 148 are perpendicularly crossed each other on the TFT substrate. The TFT, which is formed at a crossing part of the data lines 146 and the gate lines 148, supplies a data voltage from the data line 146 to a pixel electrode of the liquid crystal cell Clc in response to a scanning signal from the gate line 148. A black matrix, a color filter, and a common electrode (not shown) are formed on the color filter substrate. The common electrode is opposed to a pixel electrode with having a liquid crystal cell therebetween, and receives a common voltage Vcom. On the other hand, a common electrode, which is formed on the color filter substrate, may be formed on the TFT substrate in accordance with an electric field applying method. Polarizing plates having axes of transmitting a light, which are vertical to each other, are stuck to the TFT substrate and the color filter substrate.

The compensating circuit 145 receives digital video data Ri/Gi/Bi, which are inputted from a system interface, to modulate digital video data Ri/Gi/Bi to be displayed at a display stain and generate the modulated data Rc/Gc/Bc. The compensating circuit 145 will be described in detail as follows. Herein, as described above, a display stain may be generated in a fixed shape such as dot, line, belt, block, circle, and polygon, etc., or in an indeterminate shape having an irregular pattern, and has brightness higher or lower at the same gray scale than a normal display surface. Furthermore, the display stain includes a display stain which is brightly recognized at the same gray scale owing to the above-mentioned bright line compared to a normal display surface.

The timing controller 144 supplies the digital video data Rc/Gc/Bc, which are supplied from the compensating circuit 145, to the data driving circuit 141 in accordance with a dot clock DCLK. Furthermore, the timing controller 144 generates a gate control signal GDC that controls the gate driving circuit 142 and a data control signal DDC that controls the data driving circuit 141 using a vertical/horizontal synchronization signals Vsync and Hsync, a data enable signal DE, and a dot clock DCLK.

The data driving circuit 141 converts digital video data Rc/Gc/Bc into an analog gamma compensation voltage (a data voltage) to supply it to the data lines 146 under the control of the timing controller 144.

The gate driving circuit 142 sequentially supplies a scanning signal, which selects a horizontal line to be supplied with an analog data voltage at the display panel 143, to the gate lines 148. A data voltage from the data lines 146 is synchronized with a scanning signal to be supplied to the liquid crystal cells Clc of a horizontal line.

Figure 15:
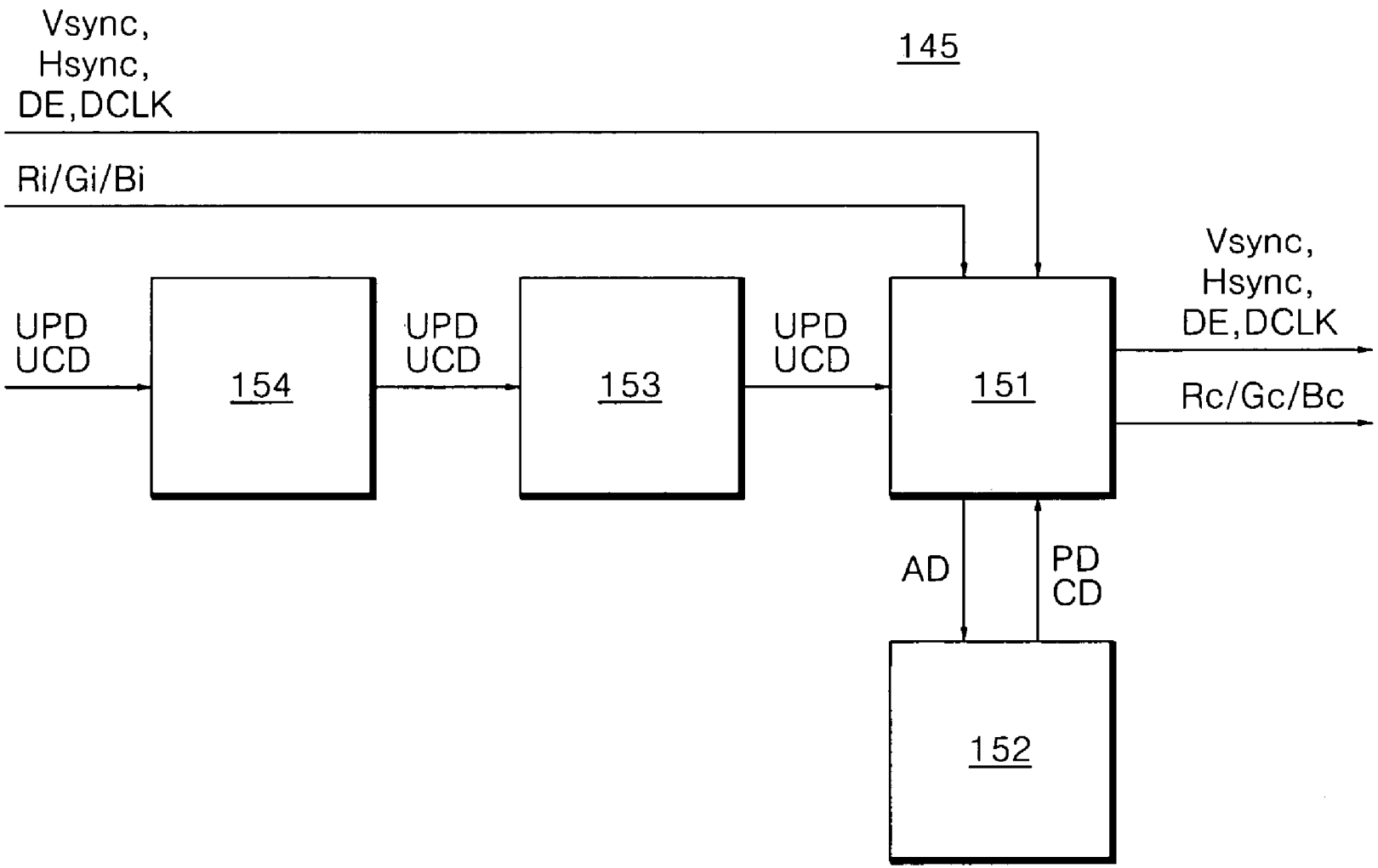
FIG. 15 is a block diagram showing in detail the compensating circuit in FIG. 14.

FIG. 15 shows the compensating circuit 145 according to the embodiment of the present invention.

Referring to FIG. 15, the compensating circuit 145 according to the embodiment of the present invention includes a memory 152, a compensating part 151, an interface circuit 154, and a register 153. Herein, the memory 152 stores location data PD and compensation data CD regarding a display stain of the display panel 143. The compensating part 151 modulates digital video data Ri/Gi/Bi using location data PD and compensation data CD, which are stored at the memory 152, to generate the modulated data Rc/Gc/Bc. The interface circuit 154 communicates with an external system. The register 153 temporarily stores data to be stored at the memory 152 via the interface circuit 154.

As described above, the memory 152 includes an EEPROM and/or and EDID ROM. Location data PD and compensation data CD are stored to the memory 152. Herein, the location data PD indicate each of the pixels which are included in a display stain of the display panel 143. The compensation data CD are assigned for each of the pixels of a display stain, and are determined to optimize compensation values for each location and for each gray scale.

The interface circuit 154 communicates the compensating circuit 154 with the external system. Herein, the interface circuit 154 satisfies a communication protocol standards such as $I^2C$, etc. An update of location data PD and compensation data CD, which are stored at the memory 152, is required due to a reason such as a change of process, and a difference between applied models, etc. The user can be connected, via a data input device of an external system, to the interface circuit 154. Accordingly, the user can read or revise data, which are stored at the memory 152, via a data input device of an external system and the interface circuit 154 in the case where an update of data is required. In this case, the data input device of the external system includes an input device such as a keyboard and a mouse, etc., which are connected to a computer, and a rom writer, which is connected to a computer.

Location data UPD and compensation data UCD to be updated are temporarily stored to the register 153. Herein, the Location data UPD and the compensation data UCD to be updated are transmitted via the interface circuit 154 so as to update location data PD and compensation data CD which are stored at the memory 152.

The compensating part 151 adds and subtracts digital video data Ri/Gi/Bi to be displayed at a display stain using location data PD and compensation data CD, which are stored at the memory 152, to generate the modulated data Rc/Gc/Bc.

Figure 16:
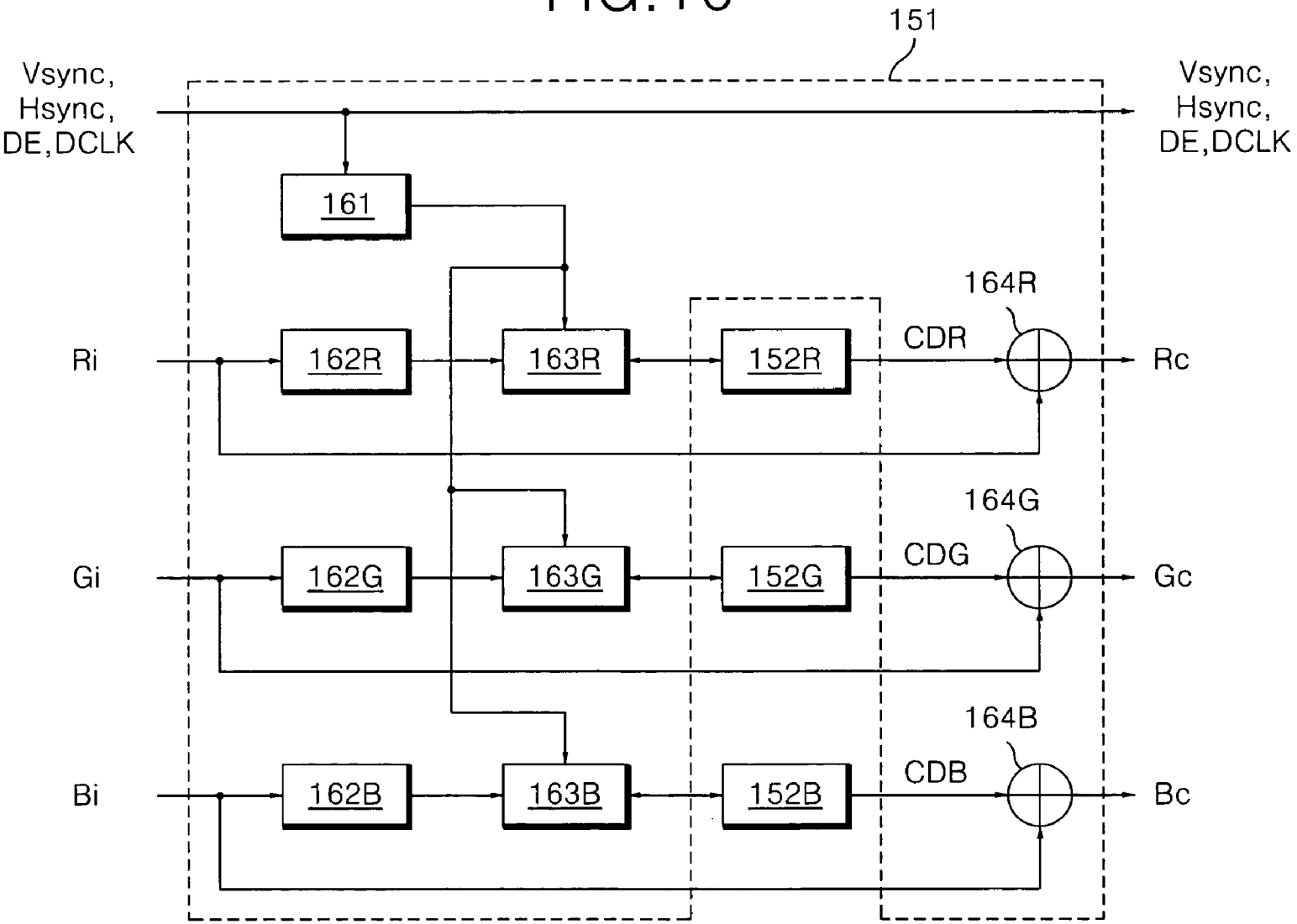
FIG. 16 is a diagram showing a compensating part according to a first embodiment of the present invention.

FIG. 16 is a diagram showing the compensating part 151 according to a first embodiment of the present invention.

Referring to FIG. 16, the compensating part 151 according to a first embodiment of the present invention includes a location judging part 161, gray scale judging parts 162R, 162G, and 162B, address generating parts 163R, 163G, and 163B, and operators 164R, 164G, and 164B.

The location judging part 161 judges a display location of digital video data Ri/Gi/Bi using a vertical/horizontal synchronization signals Vsync and Hsync, a data enable signal DE, and a dot clock DCLK, and supplies the judgment result to the address generating parts 163R, 163G, and 163B.

The gray scale judging parts 162R, 162G, and 162B judge gray scales of digital video data Ri/Gi/Bi or gray scale distances, which include the gray scales, and supplies the judgment result to the address generating parts 163R, 163G, and 163B.

The address generating parts 163R, 163G, and 163B generate a read address, which reads compensation data CDR, CDG, and CDB from the memory 152R, 152G, and 152B, using location data, which are stored the memory 152R, 152G, and 152B, a location judgment result of the location judging part 161, and a gray scale judgment result of the gray scale judging parts 162R, 162G, and 162B.

The memory 152R, 152G, and 152B output the compensation data CDR, CDG, and CDB, which are stored at a read address from the address generating parts 163R, 163G, and 163B, that is, compensation values corresponding to the digital video data Ri/Gi/Bi to be displayed at a display stain.

The operators 164R, 164G, and 164B add or subtract the compensation data CDR, CDG, and CDB to the digital video data Ri/Gi/Bi to generate the modulated data Rc/Gc/Bc. The operators 164R, 164G, and 164B may include a multiplier or a divider that multiplies or divides the digital video data Ri/Gi/Bi by the compensation data CDR, CDG, and CDB other than an adder and a subtractor.

The compensating part 151 of FIG. 16 can be applied when a compensation value is determined in an integer more than '1'. The compensating part 151, which is described in the following embodiments, can be applied when a compensation value is determined in a decimal fraction less than '1' gray scale, or in an integer+a decimal fraction more than '1' gray scale.

Figure 17:
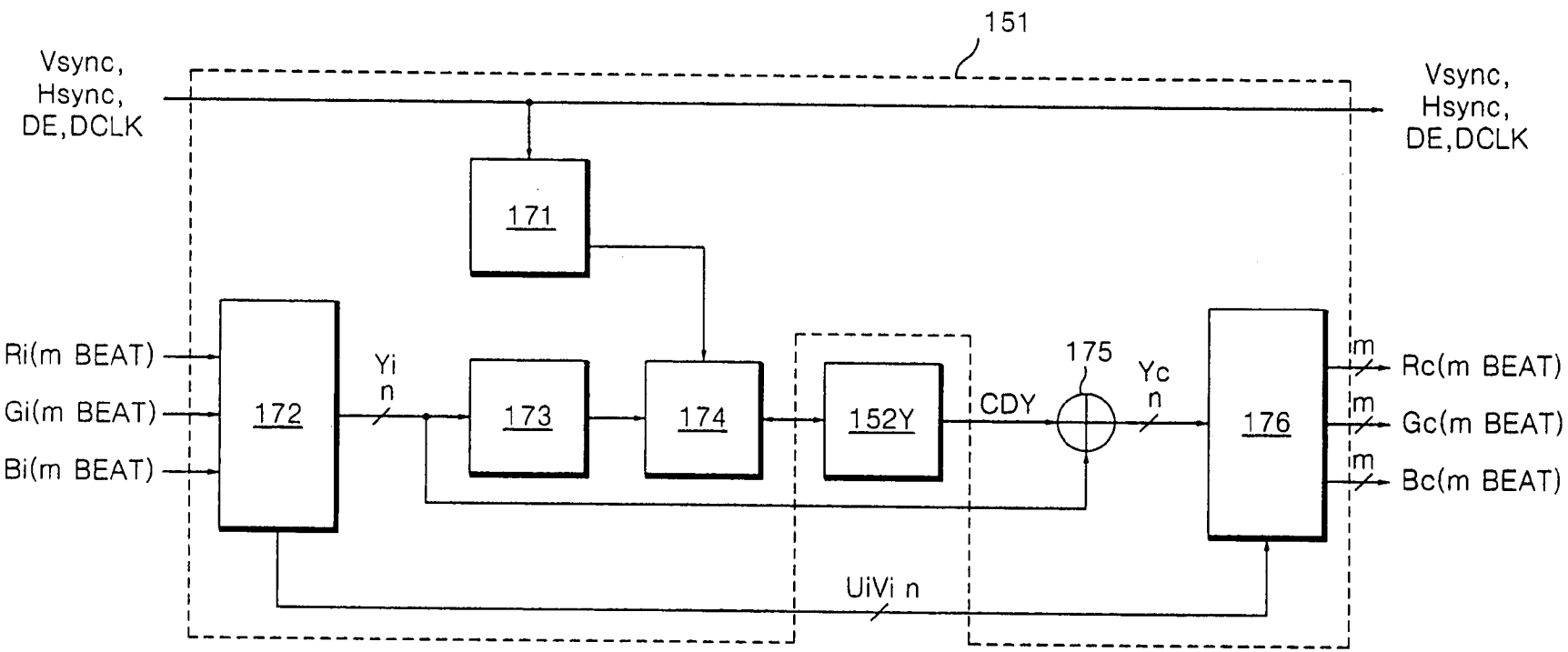
FIG. 17 is a diagram showing a compensating part according to a second embodiment of the present invention.

FIG. 17 is a diagram showing the compensating part 151 according to a second embodiment of the present invention.

Referring to FIG. 17, the compensating part 151 according to a second embodiment of the present invention includes a first converter 172, a location judging part 171, a gray scale judging part 173, an address generating part 174, an operator 175, and a second converter 176.

The compensating part 151 calculates brightness information Yi of n bits (herein, n is an integer more than m) and chromaticity information UiYi of n bits, which are extended from digital video data Ri/Gi/Bi having red R data of m bits, green G data of m bits, and blue B data of m bits, and increases and decreases brightness information Yi of n bits to first compensation data CDY, which are stored at a memory 152Y, to generate the modulated brightness information Yc of n bits. Furthermore, the compensating part 151 outputs the modulated data Rc/Gc/Bc of m bits from the modulated brightness information Yc and the non-compensated chromaticity information UiVi of m bits.

The first converter 172 calculates the brightness information Yi and the color difference information Ui/Vi of n bits in use of the following Mathematical Formula 1 to 3 which take the digital video data Ri/Gi/Bi as a variable.

$$Yi=0.299Ri+0.587Gi+0.114Bi \quad \text{[Mathematical Formula 1]}$$

$$Ui=-0.147Ri-0.289Gi+0.436Bi=0.492(Bi-Yi) \quad \text{[Mathematical Formula 2]}$$

$$Vi=0.615Ri-0.515Gi-0.100Bi=0.877(Ri-Yi) \quad \text{[Mathematical Formula 3]}$$

The location judging part 171 judges the display location of the digital video data Ri/Gi/Bi in use of a vertical/horizontal synchronization signals Vsync and Hsync, a data enable signal DE, and a dot clock DCLK to supply the judgment result to the address generating part 174.

The gray level judging part 173 judges the gray level of the digital video data Ri/Gi/Bi on the basis of the brightness information Yi from the first converter 172 to supply the judgment result to the address generating part 174.

The address generating part 174 generates a read address that reads the compensation data CDY from the memory 152Y using the location data of a display stain, which is stored at the memory 152Y, a location judgment result of the location judging part 171, and a display location and gray scale information of digital video data Ri/Gi/Bi, which are supplied from a gray scale judgment result of the gray level judging part 173.

The operator 175 adds the compensation data CDY from the memory 152Y to or subtracts the compensation data CDY from the brightness information Yi of n bits, which is supplied from the first converter 172 to modulate the brightness of the input data Ri/Gi/Bi which are to be displayed at a display stain. Herein, the operator 175 may include a multiplier or a divider that multiplies or divides the brightness information Yi of n bits by the compensation data besides the adder and subtractor.

The second converter 176 calculates the modulated data Rc/Gc/Bc m bits in use of the following Mathematical Formula 4 to 6 which take the brightness information Yc which is modulated by the operator 175 and the color difference information UiVi from the first converter 172 as a variable.

$$Rm=Yc+1.140Vi \quad \text{[Mathematical Formula 4]}$$

$$Gm=Yc-0.395Ui-0.581Vi \quad \text{[Mathematical Formula 5]}$$

$$Bm=Yc+2.032Ui \quad \text{[Mathematical Formula 6]}$$

As described above, the compensating part 151 according to the present invention increases or decreases the brightness information Yi of n bits, which includes more detailed gray scale information because the number of bits are extended, with the compensation data to minutely adjust the brightness to be displayed at a display stain of the input data Ri/Gi/Bi.

Figure 18:
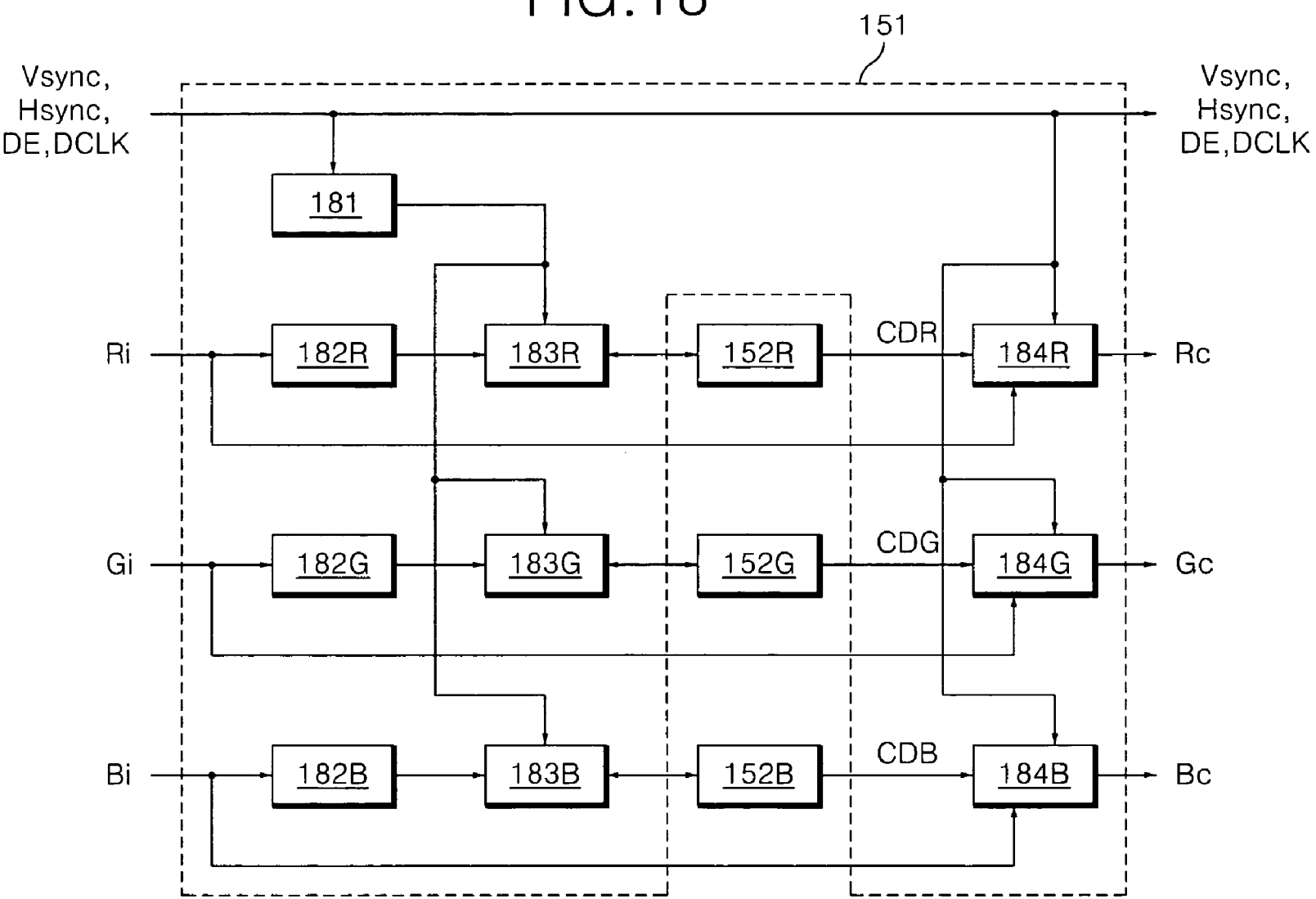
FIG. 18 is a diagram showing a compensating part according to a third embodiment of the present invention.

FIG. 18 is a diagram showing the compensating part 151 according to a third embodiment of the present invention.

Referring to FIG. 18, the compensating part 151 according to a third embodiment of the present invention includes a location judging part 181, gray scale judging parts 182R, 182G, and 182B, address generating parts 183R, 183G, and 183B, and FRC controllers 184R, 184G, and 184B.

Such a compensating part 151 periodically and spatially diffuses a compensation value, which is added to or subtracted from the digital video data Ri/Gi/Bi to be displayed at a display stain using a frame rate control, to modulate gray scale values of the digital video data Ri/Gi/Bi as much as a minor gray scale less than '1' gray scale.

The location judging part 181 judges a display location of the digital video data Ri/Gi/Bi using a vertical/horizontal synchronization signals Vsync and Hsync, a data enable signal DE, and a dot clock DCLK, and supplies the judgment result to the address generating parts 183R, 1853G, and 183B.

The gray scale judging parts 182R, 182G, and 182B judge gray scales of the digital video data Ri/Gi/Bi, and supplies the judgment result to the address generating parts 183R, 183G, and 183B.

The address generating parts 183R, 183G, and 183B generate a read address, which reads compensation data CDR, CDG, and CDB from the memory 152R, 152G, and 152B, using location data of a display stain, which is stored the memory 152R, 152G, and 152B, a location judgment result of the location judging part 181, and a gray scale judgment result of the gray scale judging parts 182R, 182G, and 182B.

The memory 152R, 152G, and 152B output the compensation data CDR, CDG, and CDB which correspond to a read address from the address generating parts 183R, 183G, and 183B.

A plurality of dither patterns, which realize each of the compensation values less than '1' gray scale, are stored at the FRC controllers 184R, 184G, and 184B. Herein, the FRC controllers 184R, 184G, and 184B add '1' to or subtract '1' from each of the digital video data Ri/Gi/Bi, which correspond to compensation pixels of the pre-stored dither patterns, and add '0' to the digital video data Ri/Gi/Bi, which correspond to non-compensated pixels of dither patterns to increase and decrease the digital video data Ri/Gi/Bi to a gray scale value less than '1' gray scale. For example, if '3/8(=0.375)' is added to the digital video data Ri/Gi/Bi to be displayed at 8 pixels×8 pixels, the FRC controllers 184R, 184G, and 184B have a size of 8 pixels×8 pixels and add the digital video data Ri/Gi/Bi to a dither pattern that realize a compensation value of '3/8'. Furthermore, if '3+3/8(=0.375)' is added to the digital video data Ri/Gi/Bi to be displayed at 8 pixels×8 pixels, the FRC controllers 184R, 184G, and 184B add '1' to each of the digital video data Ri/Gi/Bi, and add '1' to digital video data Ri/Gi/Bi, which correspond to compensation pixels within the 3/8 dither pattern. Such FRC controllers 184R, 184G, and 184B include the first FRC controller 184R that compensates red data, the second FRC controller 184G that compensates green data, and the third FRC controller 184B that compensates blue data.

Figure 19:
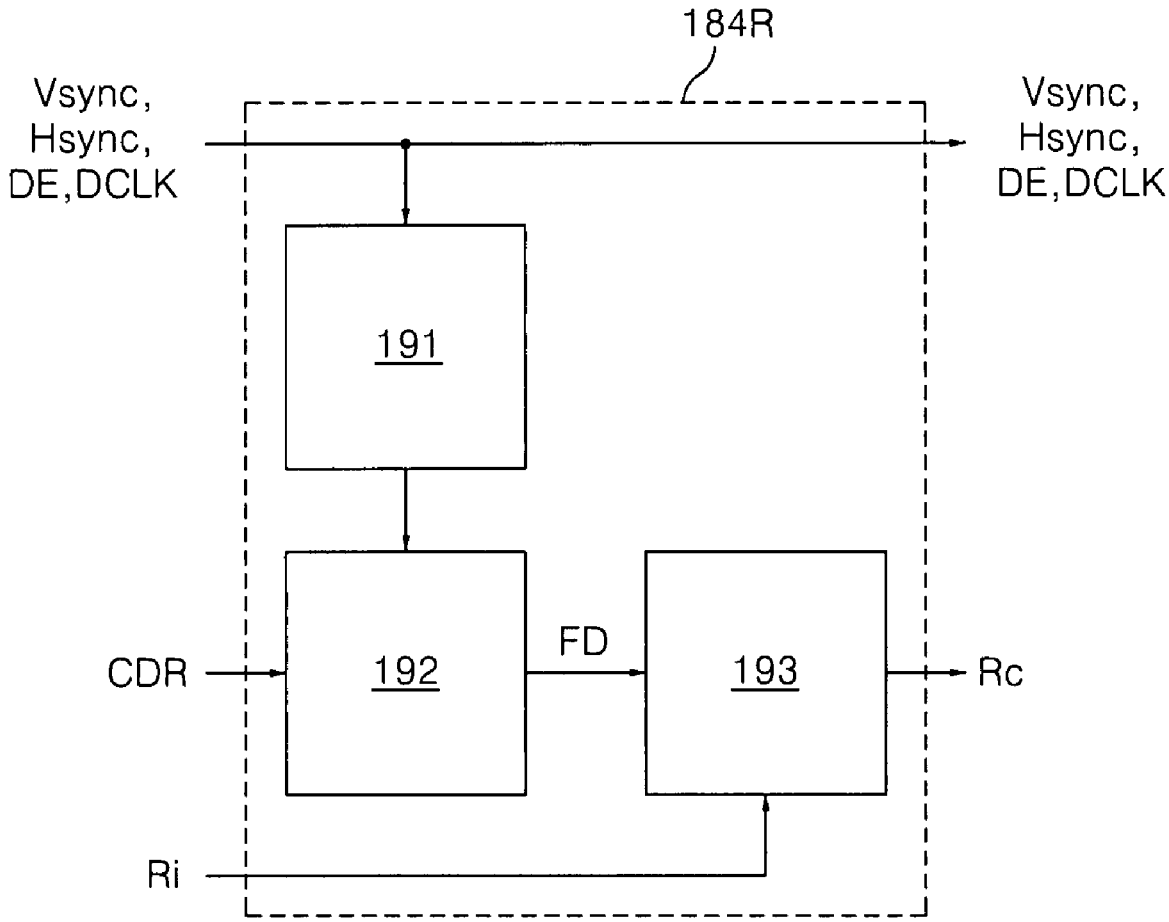
FIG. 19 is a diagram showing in detail the first FRC controller in FIG. 18.

FIG. 19 shows in detail the first FRC controller 184R.

Referring to FIG. 19, the first FRC controller 184R includes a compensation value judging part 192, a frame number sensing part 191, and an operator 193.

The frame number sensing part 191 counts at least any one of a vertical/horizontal synchronization signals Vsync and Hsync, a dot clock DCLK, and a data enable signal DE to sense a frame number. For example, the frame number sensing part 191 counts a vertical synchronization signal to sense a frame number.

The compensation value judging part 192 judges a compensation value of a R compensation data CDR from the memory 152R, and generates FRC data FD that the compensation value is dispersed by compensation pixels of a dither pattern, which is selected for the current frame period, and a frame number, which corresponds to a repeat period of a dither pattern. The compensation value judging part 192 automatically matches the pre-stored plurality of dither patterns at a frame period to scatter compensation values using a program that periodically and spatially scatters compensation values. For example, if. R compensation data CDR, which are realized as a binary data, is '000', '001', '010', '011', '100', '101', '110', and '111', respectively, the compensation value judging part 192 is pre-programmed to recognize a 0 gray scale, a 1/8 gray scale, a 2/8 gray scale, a 3/8 gray scale, a 4/8 gray scale, a 5/8 gray scale, a 6/8 gray scale, and a 7/8 gray scale as a compensation value, respectively. Furthermore, the compensation value judging part 192 automatically selects a dither pattern that realizes the compensation value.

The operator 193 increases and decreases a R digital video data Ri, which is to be supplied to a display stain, to FRC data FD to generate the modulated R digital video data Rc.

The second and third FRC controllers 184G and 184B have the same circuit configuration as the first FRC controller 184R. Accordingly, a specific description regarding the second and third FRC controllers 184G and 184B will be omitted.

Figure 20:
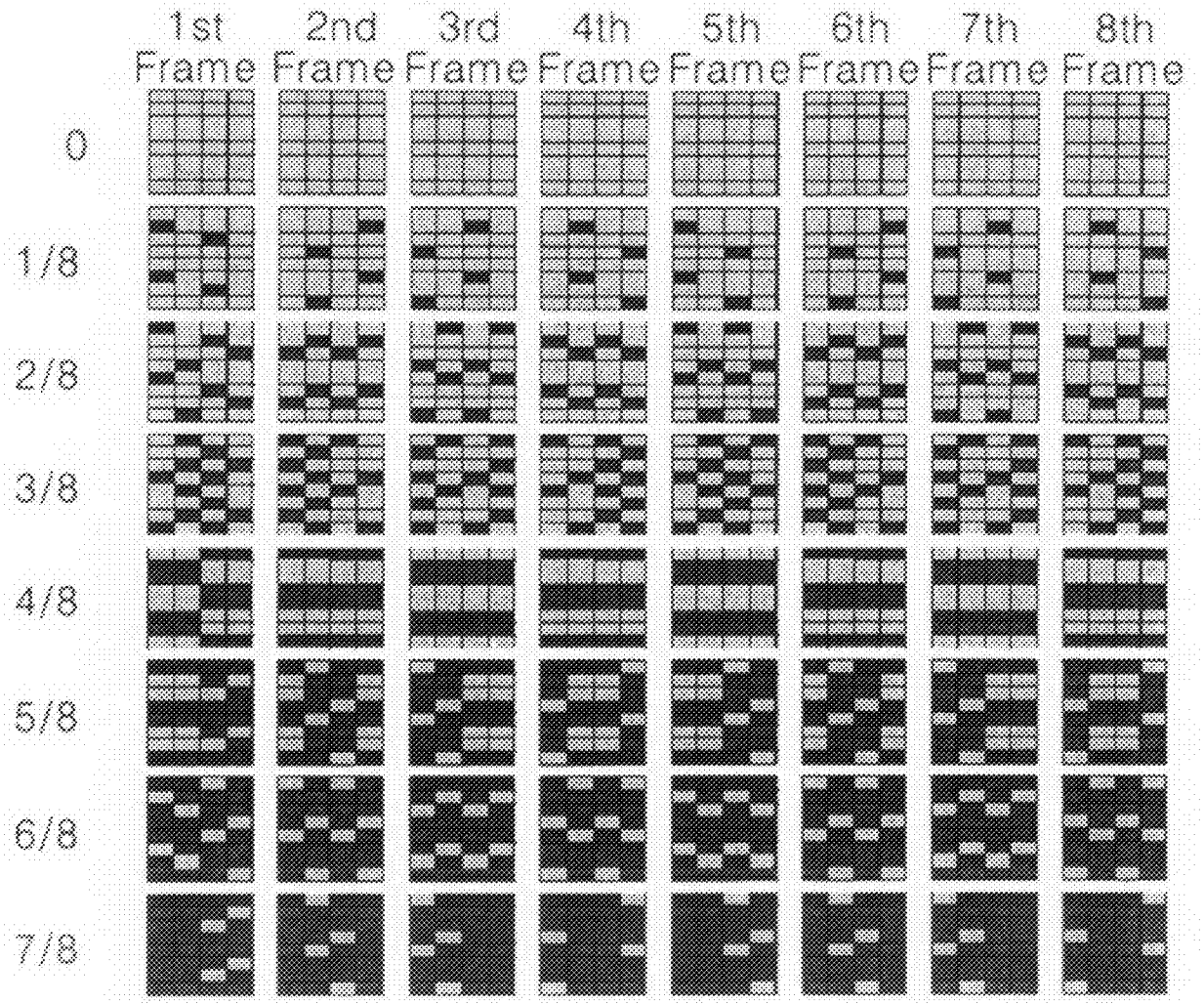
FIG. 20 is a diagram showing an example of a dither pattern that is capable of applying at the FRC controller in FIG. 18 and FIG. 19.

FIG. 20 shows a 1/8 dither pattern that realizes a compensation value of '1/8', a 2/8 dither pattern that realizes a compensation value of '2/8', a 3/8 dither pattern that realizes a compensation value of '3/8', a 4/8 dither pattern that realizes a compensation value of '4/8', a 5/8 dither pattern that realizes a compensation value of '5/8', a 6/8 dither pattern that realizes a compensation value of '6/8', and a 7/8 dither pattern that realizes a compensation value of '7/8'.

A part, which is displayed with a red color at each of the dither pattern, represents a compensation pixel that '1' is added to digital video data DDC(RGB). A compensation value is determined in accordance with the number of a compensation pixel within each dither pattern having a 4 pixels×8 pixels size. Locations of the compensation pixels are changed for each frame period so as to decrease a repeat period of a pixel to which a compensation value is applied. Furthermore, the same dither pattern is applied by an 8-frame period.

Referring to FIG. 20, the number of a compensation pixel, which is added with '1' among 32 pixels, is designated as 4, so that the 1/8 dither pattern realizes the compensation value of '1/8'. The number of a compensation pixel, which is added with '1' among 32 pixels, is designated as 8, so that the 2/8 dither pattern realizes the compensation value of '2/8'. The number of a compensation pixel, which is added with '1' among 32 pixels, is designated as 12, so that the 3/8 dither pattern realizes the compensation value of '3/8'. The number of a compensation pixel, which is added with '1' among 32 pixels, is designated as 16, so that the 4/8 dither pattern realizes the compensation value of '4/8'. The number of a compensation pixel, which is added with '1' among 32 pixels, is designated as 20, so that the 5/8 dither pattern realizes the compensation value of '5/8'. The number of a compensation pixel, which is added with '1' among 32 pixels, is designated as 24, so that the 6/8 dither pattern realizes the compensation value of '6/8'. The number of a compensation pixel, which is added with '1' among 32 pixels, is designated as 28, so that the 7/8 dither pattern realizes the compensation value of '7/8'.

On the other hand, any dither patterns of the related art other than the dither patterns shown in FIG. 20 may be used at the frame rate control of the present invention.

Figure 21:
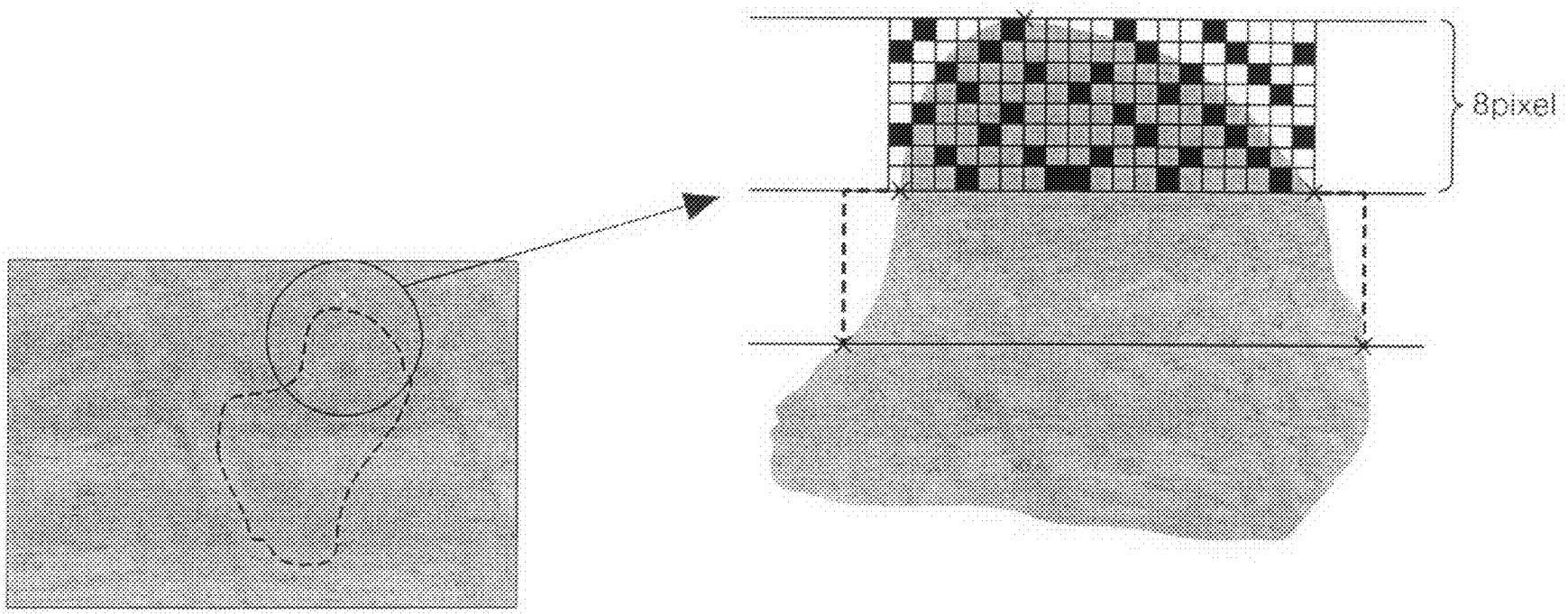
FIG. 21 is a diagram showing schematically an example of a dither pattern which is applied to a display stain of indeterminate shape.

FIG. 21 is a diagram showing schematically an example of a dither pattern which is applied to a display stain of indeterminate shape.

The flat panel display according to the embodiment of the present invention can be applied to another flat panel display other than a liquid crystal display. For example, the display panel 143 can be replaced with an electric field emitting display device, a plasma display panel, and an organic light emitting diode display device.

As described above, the method of controlling a picture quality of the flat panel display according to the embodiment of the present invention executes a program in the manufacturing process to automatically analyze a display stain of indeterminate shape and compensate brightness of the display stain of indeterminate shape on the basis of the analyzed result.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of controlling a picture quality of a flat panel display, the method comprising:

measuring brightness of a display stain, which is generated on a flat display panel and includes indeterminate shape, at a vertical direction and a horizontal direction, respectively;

selecting a direction having a high brightness change between the display stain and a normal display surface, which makes a border with the display stain, among the vertical direction and the horizontal direction in accordance with the measured result;

judging borders of the normal display surface and the display stain which brightness is changed at a selected direction, imaginarily dividing the display stain, which is determined along the judged border from the selected direction, in a plurality of division lines having an i (wherein, i is a positive integer more than 2) pixels distance along the selected direction, wherein the i pixels distance is differentiated depending upon a degree of a brightness change within the display stain, if the brightness change is high within the display stain, the number of the i pixels is decreased and if the brightness change is low within the display stain, the number of the i pixels is increased and wherein directions of the division lines are the same;

detecting edge points where the division lines and an edge of the display stain are joined and determining square display surfaces, which are defined by the detected edge points and the division lines, as compensation applying surfaces;

determining compensation values, which are applied to the compensation applying surfaces; and adjusting digital video data to be displayed at the compensation applying surfaces using the compensation values.

2. The method of controlling a picture quality of the flat panel display according to claim 1, wherein the brightness of the display stain is different from a brightness of a normal display surface in the same gray scale.

3. The method of controlling a picture quality of the flat panel display according to claim 2, wherein the display stain includes a display stain that has a brightness lower than the normal display surface, a display stain that has a brightness higher than the normal display surface, and a bright line that has a brightness higher than the normal display surface.

4. The method of controlling a picture quality of the flat panel display according to claim 3, wherein the compensation value is differentiated depending upon a gray scale value of the digital video data and a pixel location of the display stain.

5. The method of controlling a picture quality of the flat panel display according to claim 4, wherein the compensation value is added to a display stain that has a brightness lower than the normal display surface; and is subtracted from a display stain that has a brightness higher than the normal display surface and a bright line that has a brightness higher than the normal display surface.

6. The method of controlling a picture quality of the flat panel display according to claim 5, wherein the compensation value is stored at a volatile memory, which is capable of updating data, along location information that indicates each pixel location of the display stain.

7. The method of controlling a picture quality of the flat panel display according to claim 6, wherein the step of adjusting the digital video data using the compensation values includes:

judging display locations of the digital video data on the basis of the location information; and selecting digital video data to be displayed at the display stain to selectively modulate the digital video data using the compensation value.

8. The method of controlling a picture quality of the flat panel display according to claim 6, wherein the step of adjusting the digital video data using the compensation values includes:

converting the digital video data into brightness information and chromaticity information, wherein the digital video data includes red, green and blue video data having m bits (herein, m is a positive integer) and each of the brightness information and the chromaticity information have n bits (herein, n is a positive integer more than m);

judging display locations of the digital video data, which is to displayed in the display stain, on the basis of the location information;

judging a gray level of the digital video data based on the brightness information;

selecting the compensation value based on the judged display locations and the judged gray level;

modulating the brightness information of the digital video data, which is to displayed in the display stain, using the selected compensation value; and converting the modulated the brightness information and the chromaticity information into the adjusted the digital video data.

9. The method of controlling a picture quality of the flat panel display according to claim 6, wherein the step of adjusting the digital video data using the compensation values includes:

judging display locations of the digital video data, which is to displayed in the display stain, on the basis of the location information;

judging a gray level of the digital video data;

selecting the compensation value based on the judged display locations and the judged gray level;

modulating the digital video data, which is to displayed in the display stain, using the selected compensation value, wherein the selected compensation value is added to the digital video data or subtracted from the digital video data; and periodically and spatially diffusing the compensation value, which is added to or subtracted from the digital video data using a frame rate control dithering method.

* * * * *